US005271374A

United States Patent [19]

Nagaishi et al.

[11] Patent Number: 5,271,374

[45] Date of Patent: Dec. 21, 1993

[54] AIR-FUEL RATIO CONTROLLER FOR ENGINE

[75] Inventors: Hatsuo Nagaishi; Hiroshi Iwano, both of Kanagawa, Japan

[73] Assignee: Nissan Motor Co., Ltd., Japan

[21] Appl. No.: 913,689

[22] Filed: Jul. 15, 1992

[30] Foreign Application Priority Data

Jul. 16, 1991 [JP] Japan ..... 3-175030
Jul. 25, 1991 [JP] Japan ..... 3-186588
Aug. 7, 1991 [JP] Japan ..... 3-198004

[51] Int. Cl.[5] ..... F02D 41/14
[52] U.S. Cl. ..... 123/675
[58] Field of Search ..... 123/674, 675

[56] References Cited

U.S. PATENT DOCUMENTS 4,907,558 3/1990 Manaka et al. ..... 123/675

FOREIGN PATENT DOCUMENTS

60/145443 7/1985 Japan .
63/38656 2/1988 Japan .
63/41635 2/1988 Japan .
75327 4/1988 Japan ..... 123/675
1/138345 5/1989 Japan .
3/111639 5/1991 Japan .
3-111642 5/1991 Japan .

*Primary Examiner*—Tony M. Argenbright
*Attorney, Agent, or Firm*—Lowe, Price, LeBlanc & Becker

[57] ABSTRACT

The first mixing ratio error in a transient state is sampled as a pre-transient error, the last mixing ratio error in the transient state is sampled as a post-transient error, and the peak value of the mixing ratio errors in the transient state is also sampled. The difference between either this pre-transient mixing ratio error or post-transient mixing ratio error depending on whichever is the nearer to a peak value, and the peak value of said mixing ratio errors, is computed. Injection fuel correction amounts in transient running states are learned and the learned values are stored in a memory so as to eliminate this difference. By correcting the injection fuel amounts based on these learned values in transient running states, the effect of steady state errors on the transient learning precision is eliminated and instantaneous lean peaks in the air-fuel ratio are smoothed out.

8 Claims, 19 Drawing Sheets

AIR-FUEL RATIO CONTROLLER FOR ENGINE

FIELD OF THE INVENTION

This invention relates to an engine air-fuel ratio (AFR) controller, and more specifically, a controller which not only provides feedback control of the AFR but also learning control of the AFR by means of previously learned correction values.

BACKGROUND OF THE INVENTION

In order to make effective use of a three-way catalyst used to process CO, HC and NOx, which are toxic substances present in engine exhaust gases, the engine must be operated at the theoretical AFR.

In engines using a three-way catalyst to process exhaust gases, an $O_2$ sensor installed in the exhaust manifold is used to detect whether the combustion is on the rich or on the lean side, and the AFR is feedback-controlled to a theoretical AFR by adjusting the fuel supplied by a fuel injector based on the detected value.

However it is difficult to ensure sufficient response capacity from this kind of feedback control.

Tokkai Sho 60-145443, 63-41635, 63-38656 and Tokkai Hei 1-138345 published by Japanese Patent Office therefore disclose methods of improving the response and control precision by learning during a sampling period under a variety of different conditions, and applying correction values based on these learned values to control the AFR.

This system is applied to fuel injection devices of the L-Jetronic type, wherein the injection pulse width TI corresponding to the amount of fuel required in one ignition cycle is given by the following relation:

$$TI = Tp \times Co \times \alpha \times \alpha m + Ts$$

where,

Tp is a basic pulse width of a fuel injection, $$Tp = K \times Qa/N$$

K is a constant, Qa is intake volume and N is engine speed.

$\alpha$ is an AFR feedback control coefficient calculated according to the deviation between the real mixing ratio and a predetermined target ratio. The mixing ratios are calculated from the AFR by the equation:

Real mixing ratio = theoretical air-fuel ratio/real air-fuel ratio

Target mixing ratio = theoretical air-fuel ratio/target air-fuel ratio

Co are various correction coefficients to improve specific running conditions of the engine.

Ts is an ineffectual pulse width.

Here, $\alpha m$ is an AFR learning correction coefficient introduced for the purpose of improving the response of the AFR correction. These parameters may be represented by a learning area for storage of AFR coefficients $\alpha m$. This learning area is divided into a plurality of small areas with Tp and N as coordinates, and $\alpha m$ is updated in each small area.

In one small area, for example, when a certain set of predetermined conditions are satisfied, (e.g. the AFR feedback signal is sampled a certain number of times during feedback control), updated learned values are calculated from an intermediate value of $\alpha$ computed from the AFR sensor output and a learned value which previously occupied this small area, and the result of this calculation is stored in the same area.

This type of learning control finds a mixing ratio error area during an acceleration judgment period (sampling period), and performs learning such that the error area is 0.

The mixing ratio error is a value obtained by subtracting the target mixing ratio from the real mixing ratio. If the mixing ratio error area is negative, for example, the real mixing ratio is too lean, so transient learned values are updated to make it richer. This type of learning control is effective for improving exhaust emissions, and as the AFR is particularly liable to fluctuate during transient running conditions, learning is very much required at these times.

There are however the following problems in performing this type of learning under transient running conditions.

Firstly, when a steady state error exists at the end of a sampling period (end of acceleration) due to a performance scattering of deterioration of the fuel injectors and air flow meters, learning precision declines if this error is incorporated in the errors occurring under transient conditions.

Further, if learning is applied only to the error area, sudden displacements of the AFR to the lean or rich side responsible for the hesitation or stumbling of the engine that tends to occur in transient conditions cannot effectively be suppressed.

SUMMARY OF THE INVENTION

It is therefore an object of this invention to improve the learning precision of engine AFR control under transient running conditions by eliminating the incorporation of steady state errors.

It is a further object of this invention to smooth out sudden rich and lean peaks in the AFR.

In order to achieve the above objects, this invention provides an air-fuel ratio controller for an engine which have a combustion chamber, an air intake passage for supplying air to the combustion chamber and a fuel injector for injecting fuel into the intake passage.

This controller comprises a device for calculating a target mixing ratio based on the engine running conditions, a device for detecting a real mixing ratio of fuel and air supplied to the combustion chamber, a device for detecting a difference between the real mixing ratio and the target mixing ratio as a mixing ratio error, a device for computing a mixing ratio feedback correction coefficient for feedback correction of an injection fuel amount based on the mixing ratio error, a device for applying a correction to the injection fuel amount based on the feedback correction coefficient, a device for detecting whether the engine is in a transient running state, a memory for continuous storage of mixing ratio errors in the transient running state, a device for sampling peak values of the mixing ratio errors in the transient running state, a device for sampling the first mixing ratio error when the engine is judged to be in the transient running state as a pre-transient error, a device for sampling the last mixing ratio error when the engine is judged to be in the transient running state as a post-transient error, a device for finding whichever of the pre-transient mixing ratio error and post-transient mixing ratio error is the nearer to the peak value, a device for computing the difference of the mixing ratio error found and the peak value, a device for computing an injection fuel correction amount in the transient running state so as to eliminate this difference, a memory for storing the computed correction amount as a learned value, and a device for correcting the injection fuel amount in the transient running state based on a previously learned value.

The real mixing ratio detection device in this controller may comprise an air-fuel ratio sensor for directly detecting the air-fuel ratio from the engine exhaust gas composition, and a device for converting the air-fuel ratio to the mixing ratio.

Alternatively, the real mixing ratio detection device may comprise an $O_2$ sensor of which the output varies sharply at the theoretical air-fuel ratio in response to the engine exhaust gas composition, a device for judging whether or not the $O_2$ sensor output has varied sharply, and a device for computing the real mixing ratio from the target mixing ratio and the feedback correction coefficient when the $O_2$ sensor output has varied sharply.

Alternatively, the real mixing ratio detection device may comprise an $O_2$ sensor of which the output varies sharply at the theoretical air-fuel ratio in response to the engine exhaust gas composition, a device for judging whether or not the $O_2$ sensor output has varied sharply, and a device for computing the real mixing ratio from the feedback correction coefficient when the $O_2$ sensor output has varied sharply, the target mixing ratio computed several preceding occasions beforehand and a predetermined damping coefficient.

This invention also provides another air-fuel ratio controller for an engine having a combustion chamber, an intake passage for supplying air to the chamber and a fuel injector for injecting fuel into the intake passage.

This controller comprises a device for calculating a target mixing ratio based on the engine running conditions, a device for detecting a real mixing ratio of fuel and air supplied to the combustion chamber, a device for detecting a difference between the real mixing ratio and the target mixing ratio as a mixing ratio error, a device for computing a mixing ratio feedback correction coefficient for feedback correction of an injection fuel amount based on the mixing ratio error, a device for applying a correction to the injection fuel amount based on the feedback correction coefficient, a device for detecting whether the engine is in a transient running state, a device for detecting an amount representative of the transiency of the transient running state, a memory for continuous storage of the mixing ratio errors and the transiency amounts in the transient running state, a device for computing the slope of the correlation between the stored mixing ratio errors and transiency amounts, a device for computing an injection fuel correction amount in the transient running state so as to eliminate this slope, a memory for storing the computed correction amount as a learned value, and a device for correcting the injection fuel amount in the transient running state based on a previously learned value.

The real mixing ratio detection a device in this controller may comprise an air-fuel ratio sensor for directly detecting the air-fuel ratio from the engine exhaust gas composition, and a device for converting the air-fuel ratio to the mixing ratio.

Alternatively, the real mixing ratio detection a device may comprise an $O_2$ sensor of which the output varies sharply at the theoretical air-fuel ratio in response to the engine exhaust gas composition, a device for judging whether or not the $O_2$ sensor output has varied sharply, and a device for computing the real mining ratio form the target mixing ratio and the feedback correction coefficient when the $O_2$ sensor output has varied sharply.

Alternatively, the real mixing ratio detection a device may comprise an $O_2$ sensor of which the output varies sharply at the theoretical air-fuel ratio in response to the engine exhaust gas composition, a device for judging whether or not the $O_2$ sensor output has varied sharply, and a device for computing the real mixing ratio from the feedback correction coefficient when the $O_2$ sensor output has varied sharply, the target mixing ratio computed several preceding occasions beforehand and a predetermined damping coefficient.

The details as well as other features and advantages of this invention are set forth in the remainder of the specification and are shown in the accompanying drawings.

DESCRIPTION OF THE PREFERRED EMBODIMENTS

FIGS. 1–17 illustrate a first embodiment of this invention.

Figure 1:
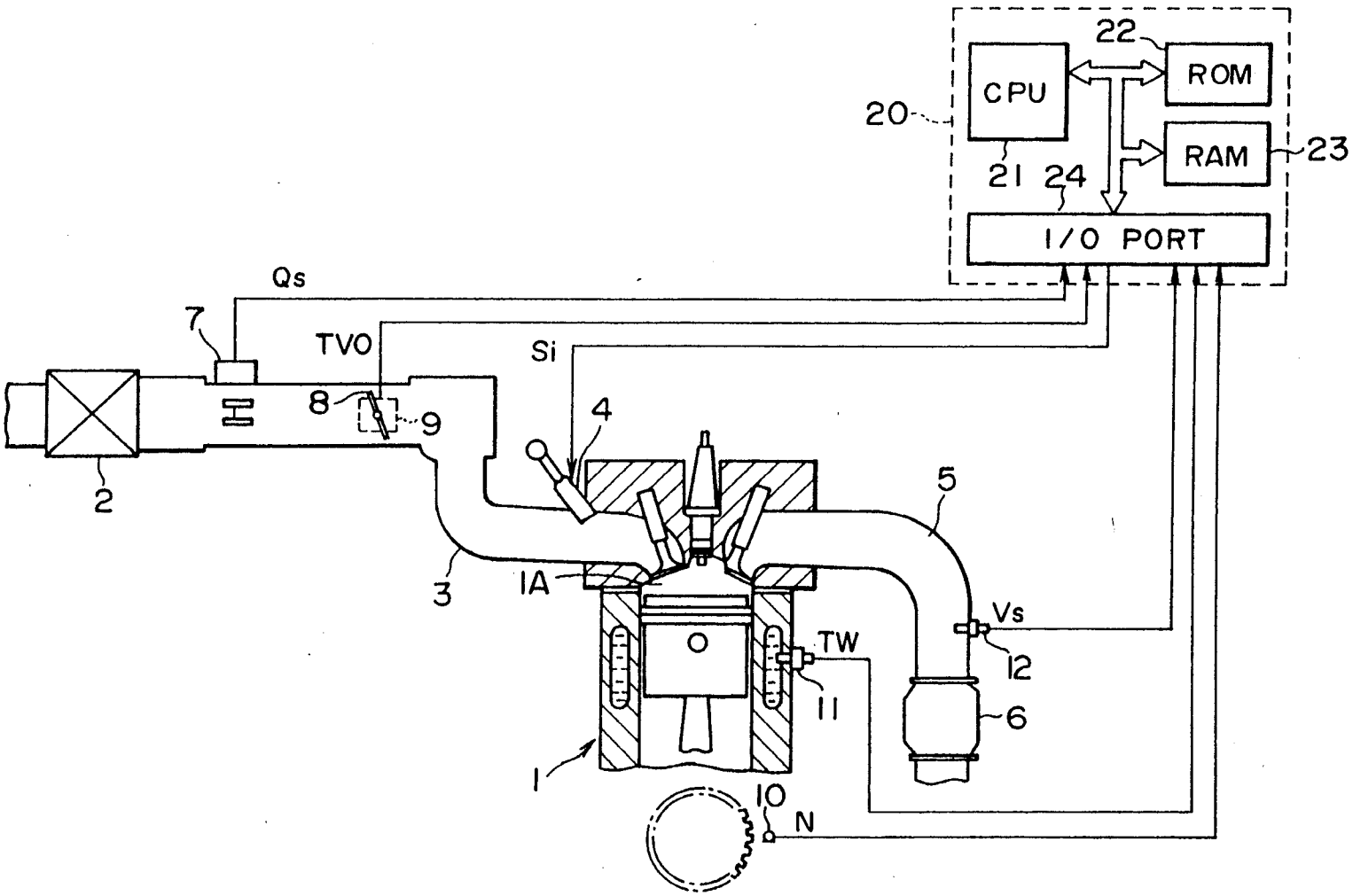
FIG. 1 is a schematic diagram of a first embodiment of this invention.

In FIG. 1, each cylinder of an engine 1 is provided with a combustion chamber 1A. Air is supplied to this combustion chamber 1A from an air cleaner 2 via an intake passage 3, its flowrate being controlled by a throttle valve 8 in synchronism with an accelerator pedal.

Fuel is injected toward each air intake port of the engine 1 from a fuel injector 4 provided in each cylinder of the engine 1 based on an injection signal Si. This injected fuel and the air flowing into the cylinder are mixed, the gas mixture is burnt with the assistance of an injection flame in the cylinder, and the burning gases depress a piston. After performing this work, the burnt gases are led via an exhaust passage 5 into a catalystic converter 6 where toxic components of the burnt gas (CO, HC and NOx) are treated by a three-way catalyst and expelled.

An AFR controller is provided with an air flow meter 7 which detects the intake air flowrate Qs, a throttle opening sensor 9 which detects the opening TVO of a throttle valve 8, a crank angle sensor 10 which detects the engine speed N of the engine 1, a water temperature sensor 11 which detects the cooling water temperature TW of a water jacket, and an AFR sensor 12 which detects the AFR (mixing ratio) of the gas mixture supplied to the combustion chamber 1A of the engine over a wide range of air-fuel ratios varying from rich to lean from the oxygen concentration of the exhaust gases. Output signals from the aforesaid devices are input to a controller 20 consisting of a microcomputer.

In the controller 20, a basic injection pulse width Tp is determined according to running conditions determined by the intake flowrate Qs and the engine speed N, and the AFR of the gas mixture flowing into the cylinder is controlled close to a target value by opening the fuel injector 4 for the duration of this pulse width Tp. The AFR is also feedback-controlled to a theoretical AFR by the signal from the AFR sensor 12 so that the three-way catalyst works effectively.

Further, in the controller 20, the fuel injection amount is corrected for each cylinder based on the variation of the pulse width AVTP corresponding to the aforesaid cylinder intake air volume compared to that in the previous injection, and a fuel wall flow amount that occurs during synchronous injection is also corrected. The wall flow is a flow of injected fuel along the inner wall of the air intake passage 3 which reaches the combustion chamber 1A later than the fuel which has first been mixed with air.

These corrections have been disclosed in Tokkai Hei 3-111639 published by the Japanese Patent Office.

Figure 7:
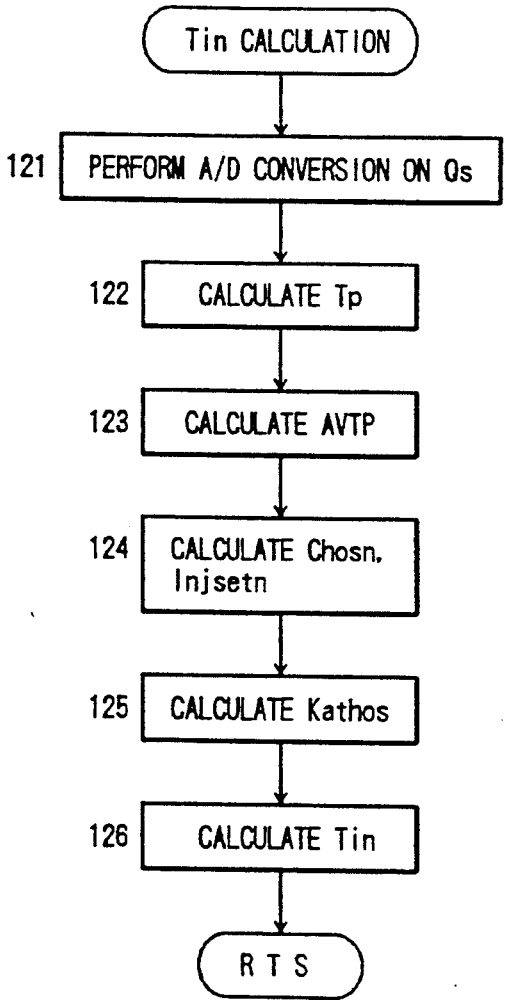
Figure 8:
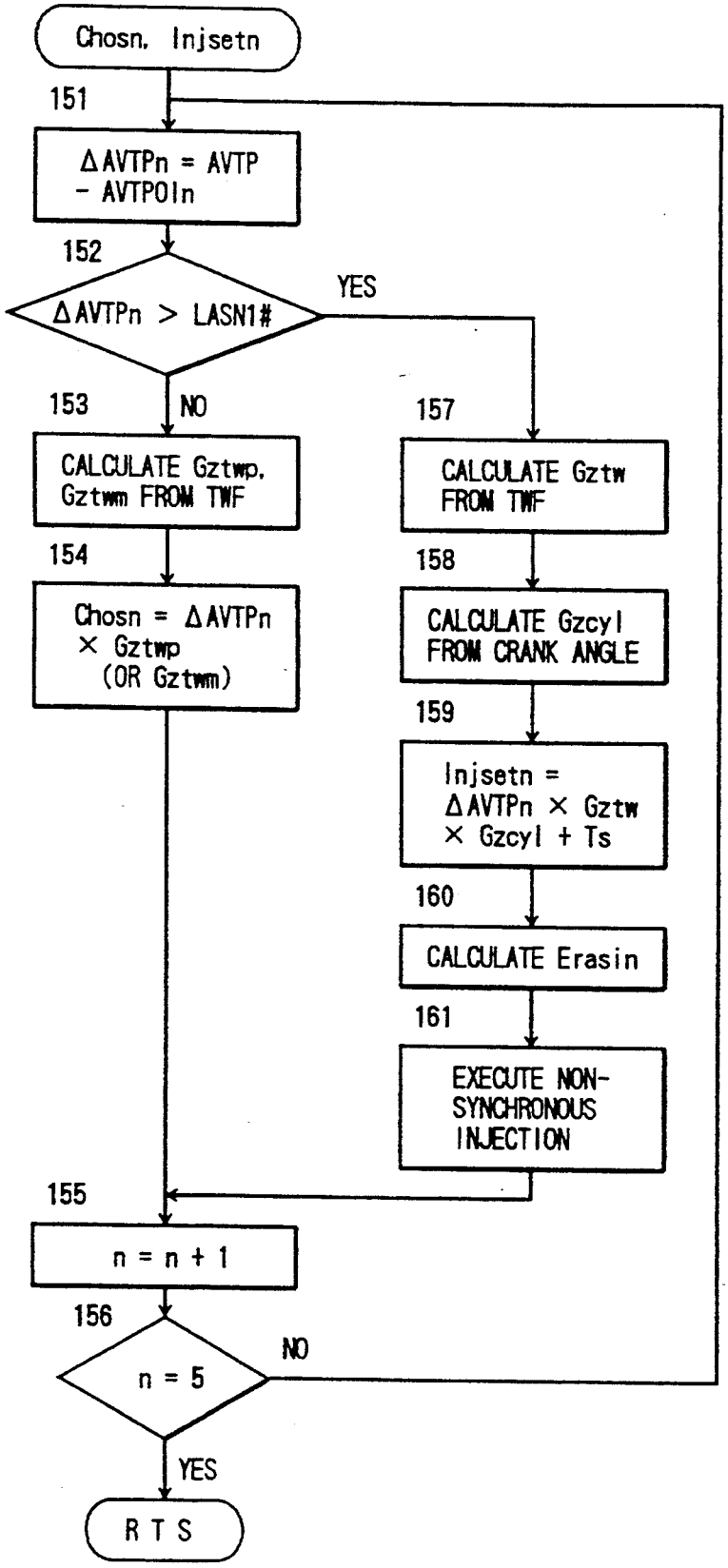

This control, as shown in FIG. 7, is performed by first dividing the intake air flowrate Qs (g/s) by the engine speed N (rpm), finding the intake air volume for one revolution, and calculating a proportional value as a basic injection pulse width Tp (=K·Qs/N, where K is a constant) (Step 122).

The pulse width AVTP (ms) corresponding to the cylinder intake air volume is then found using a weighting average coefficient Fload (%) from the basic injection pulse width TP (ms) (Step 123):

$$AVTP = Tp \cdot Fload + \text{old } AVTP \cdot (1 - Fload)$$

This equation takes account of the fact that there is a delay from the time when the flow passes the position of the air flow meter to the time when it reaches the position of the cylinder. The old AVTP is a value found in the immediately preceding injection. This AVTP is a fuel injection amount under steady state running conditions, and a fuel correction must be made for acceleration or deceleration. A transient correction amount Kathos (ms) corresponding to the fuel wall flow is thus computed (Step 125), and a synchronous pulse width Tin (ms) for each cylinder is then determined by an equation covering both transient and steady state running conditions as follows (Step 126):

$$Tin = (AVTP + Kathos) \times TMR \times (\alpha + \alpha m) + Chosn - Erascin + Ts$$

where

TMR = target mixing ratio (dimensionless)

$\alpha$ = AFR feedback correction coefficient (dimensionless)

$\alpha m$ = AFR learning correction coefficient (dimensionless)

Chosn = increase/decrease correction amount specific to the cylinder (ms)

Erascin = over-injection correction amount specific to the cylinder (ms)

Ts = ineffectual pulse width (ms)

In multi-cylinder engines, other corrections such as fuel scatter between cylinders are also necessary. Related values (the increase/decrease correction amount Chosn and over-injection correction amount Erascin specific to the cylinder, and an asynchronous injection amount Injsetn specific to the cylinder) are found by the sub-routine shown in FIG. 8.

The transient correction is intended to correct for fuel wall flow which varies relatively slowly. A steady state fuel wall deposition amount Mfh is first memorized for different running conditions, and the change in the wall deposition amount under transient conditions is then assigned in a suitable proportion for each fuel injection as an overall correction amount.

Figure 9:
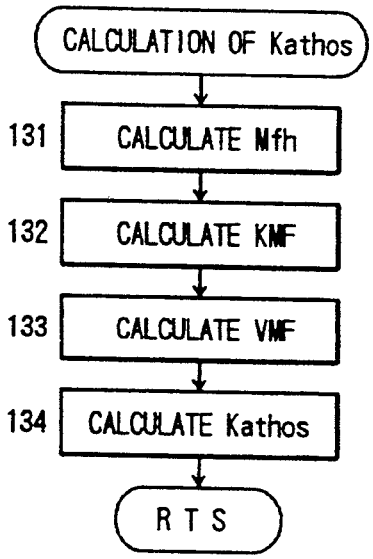

The steady state deposition amount Mfh (ms) for fuel wall flow inside the air intake passage 3 is therefore found as shown in FIG. 9 (Step 131). The steady state deposition amount Mfh (ms) should be proportional to the pulse width AVTP corresponding to the cylinder air intake volume, the proportionality constant being Mfhqt. This proportionality constant Mfhqt varies with the temperature of the fuel adhering to the wall and with the air volume in the throttle valve, and is determined experimentally.

As the temperature of parts on which fuel is deposited cannot be measured directly, a temperature prediction value TWF (°C.) is used. The temperatures of these parts (e.g. air intake valves) may be different from the cooling water temperature TW due to factors such as fuel cut, start-up or the orientation of the injector. If the wall deposition amount were calculated based on the cooling temperature TW, therefore, the steady state deposition amount Mfh would vary by this difference leading to a shift of the AFR under transient conditions. TWF is thus introduced to eliminate the discrepancy. The use of the temperature prediction value TWF as an indicator of the temperature of parts with deposited fuel is disclosed for example in Tokkai Hei 3-111642 and Tokkai Hei 3-13423 published by the Japanese Patent Office.

If a deposition prediction amount (referred to hereafter simply as a deposition amount) at any current time is Mf (ms), the wall flow during acceleration will be equal to a difference Mfh-Mf and the fuel in the combustion chamber 1A will be correspondingly leaner. This difference Mfh-Mf is therefore multiplied by a deposition variation rate KMF (%) so as to determine a wall flow variation (referred to hereafter as a deposition rate) per injection VMF (ms) (Step 133). In other words, if an extra amount of fuel VMF is not supplied per injection, the amount of fuel entering the cylinder will be insufficient.

During acceleration, this is the transient correction amount Kathos (ms). During deceleration, on the other hand, the product of multiplying VMF by a correction factor Ghf to prevent overlean when using light fuel may be set as Kathos.

Figure 10:
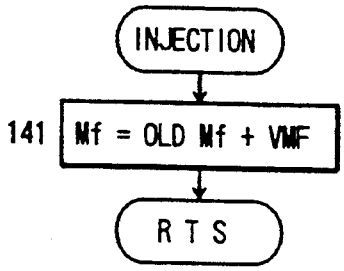
Figure 11:
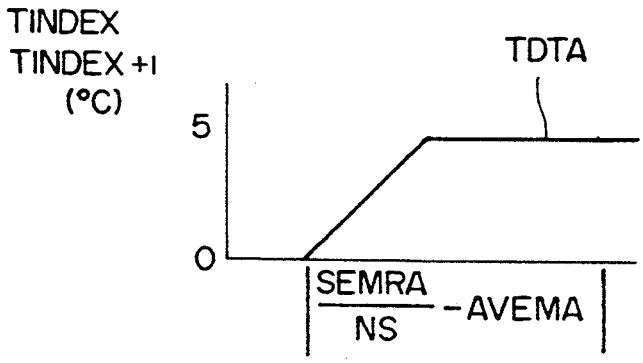
FIG. 11 is a graphical representation of the contents of a TDTA table used in the first embodiment of this invention.
Figure 12:
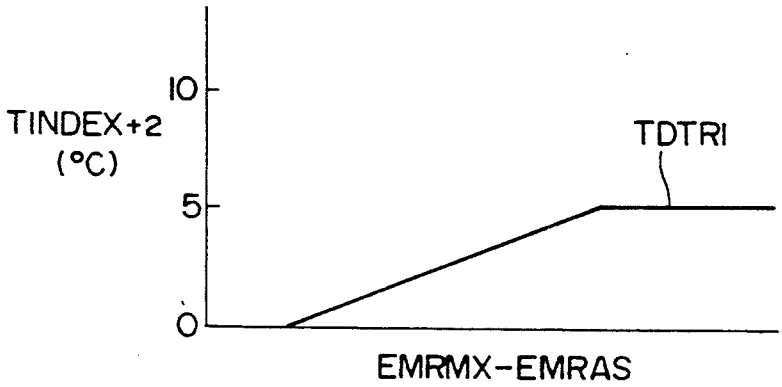
FIG. 12 is a graphical representation of the contents of a TDTR1 table used in the first embodiment of this invention.
Figure 13:
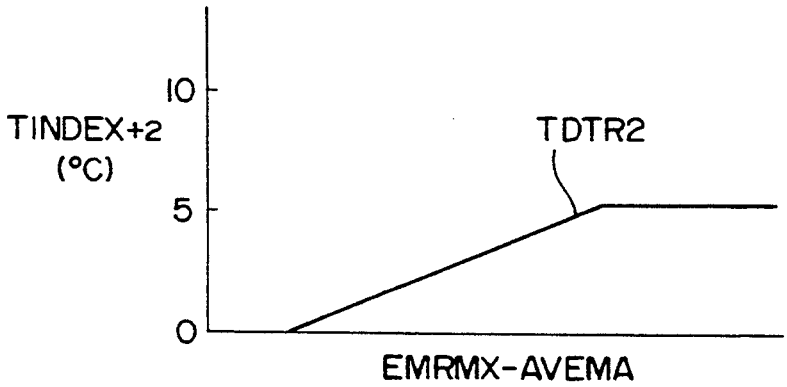
FIG. 13 is graphical representation of the contents of a TDTR2 table used in the first embodiment of this invention.
Figure 14:
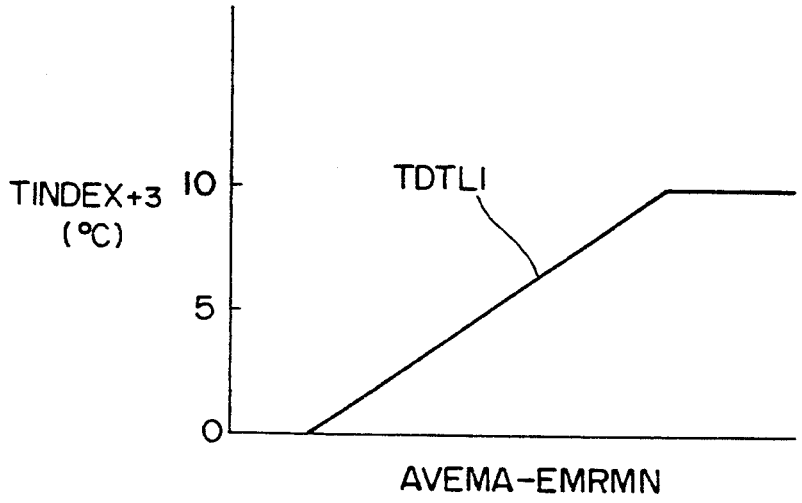
FIG. 14 is a graphical representation of the contents of a TDTL1 table used in the first embodiment of this invention.
Figure 15:
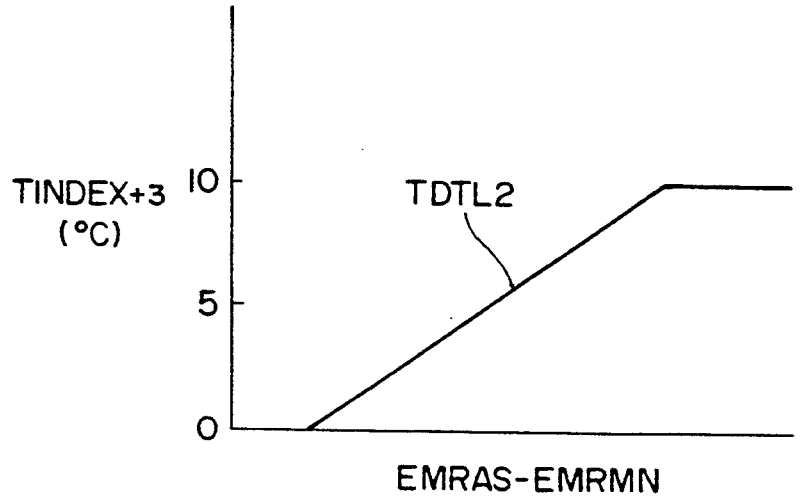
FIG. 15 is a graphical representation of the contents of a TDTL2 table used in the first embodiment of this invention.

As the fuel wall flow amount is increased by the aforesaid VMF due to the present injection, the product of adding this increase to the deposition amount Mf when the immediately preceding injection is complete will be the deposition amount Mf when the present injection is complete. Mf is thus an integral value as shown in FIG. 10.

The transient correction amount Kathos depends on the temperature prediction value TWF as described hereintofore, and transient learning is introduced into the computation process of TWF.

Figure 17:
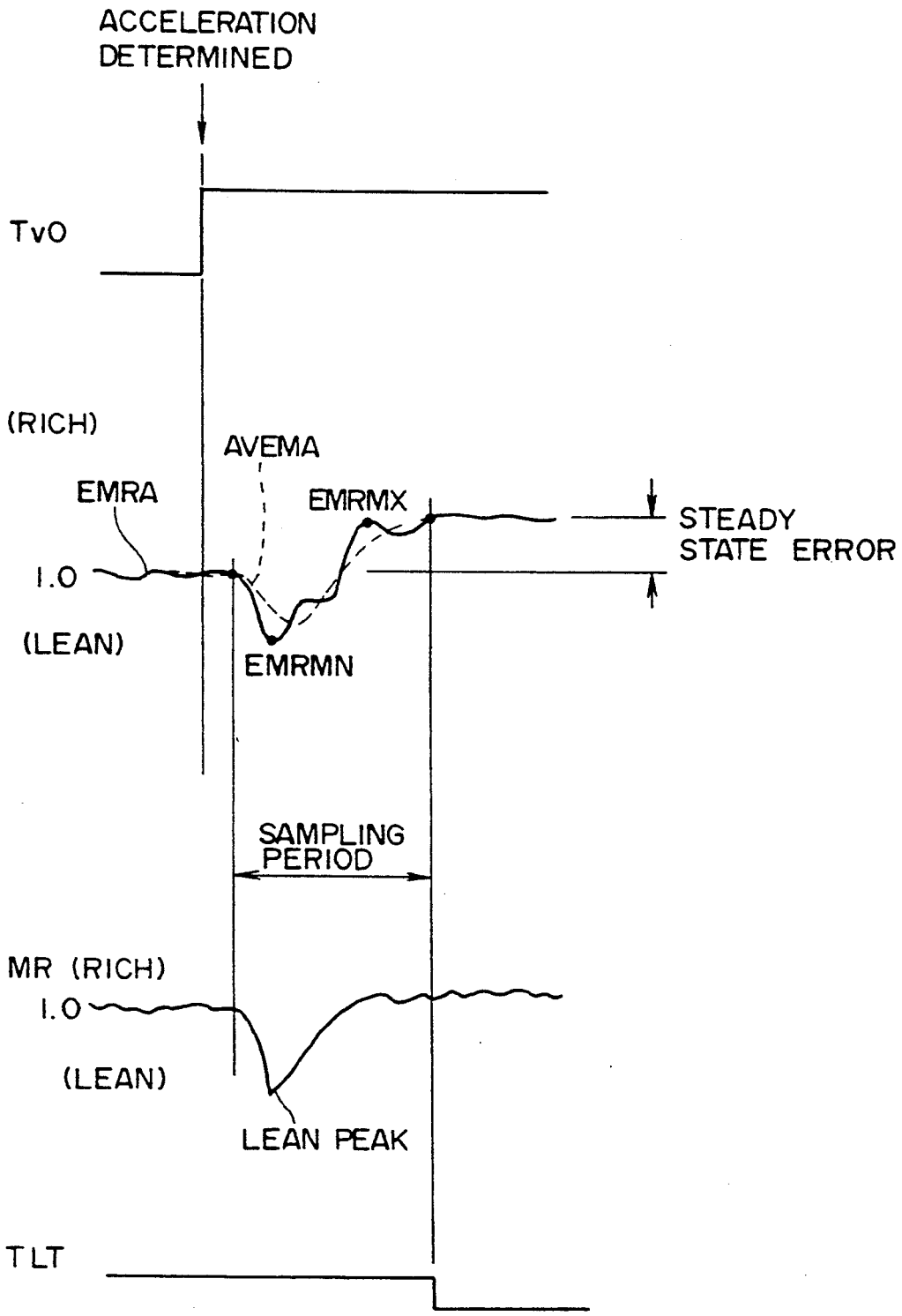
FIG. 17 is a graph describing the learning of fixed errors during acceleration in the first embodiment of this invention.

Transient learning is performed on the basis of a mixing ratio error which is the difference between the real mixing ratio and the target mixing ratio. As shown in FIG. 17, a large fixed error may remain in this mixing ratio error after the transient conditions have passed. The meaning of the symbols in the figure will be explained hereinafter.

In this case, if learning is performed by mixing ratio error area learning during the sampling period, the error areas above and below EMRA=1 after learning are equal so that the total error is zero, but the real mixing ratio MR stabilizes on the lean side in the sampling period. If a lean peak should suddenly occur in this stable state, the engine may hesitate or stumble. FIG. 17 is therefore an example where drivability is adversely affected due to steady state errors.

Figure 16:
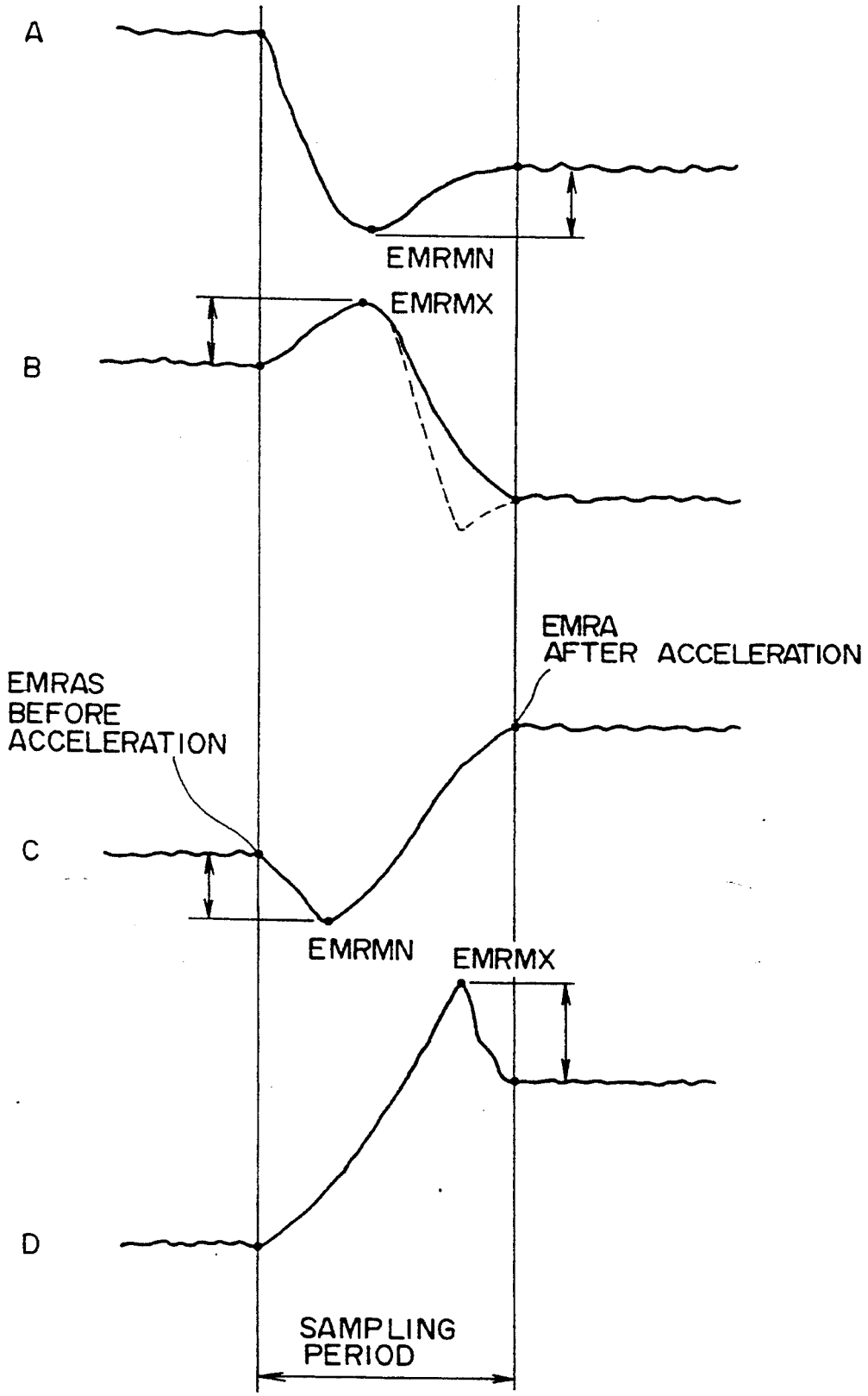
FIG. 16 is a graph describing the learning of rich and lean peaks of the mixing ratio error in the first embodiment of this invention.

There are 4 basic cases where drivability is adversely affected due to steady state errors, as shown in FIG. 16. These cases may of course also occur in combination (e.g. as shown by the dotted line).

The controller 20 therefore learns by updating the amount by which the minimum value EMRMN of the mixing ratio error is smaller than the smaller of the mixing ratio errors before and after the transient period (Cases A and C in FIG. 16, see arrow), and updating the amount by which the maximum value EMRMX of the mixing ratio error exceeds the greater of the mixing ratio errors before and after the transient period (Cases B and D in FIG. 16).

To perform this updating, the mixing ratio errors before and after the transient period, and the minimum and maximum values of the mixing ratio errors during the transient period, are required.

Figure 2:
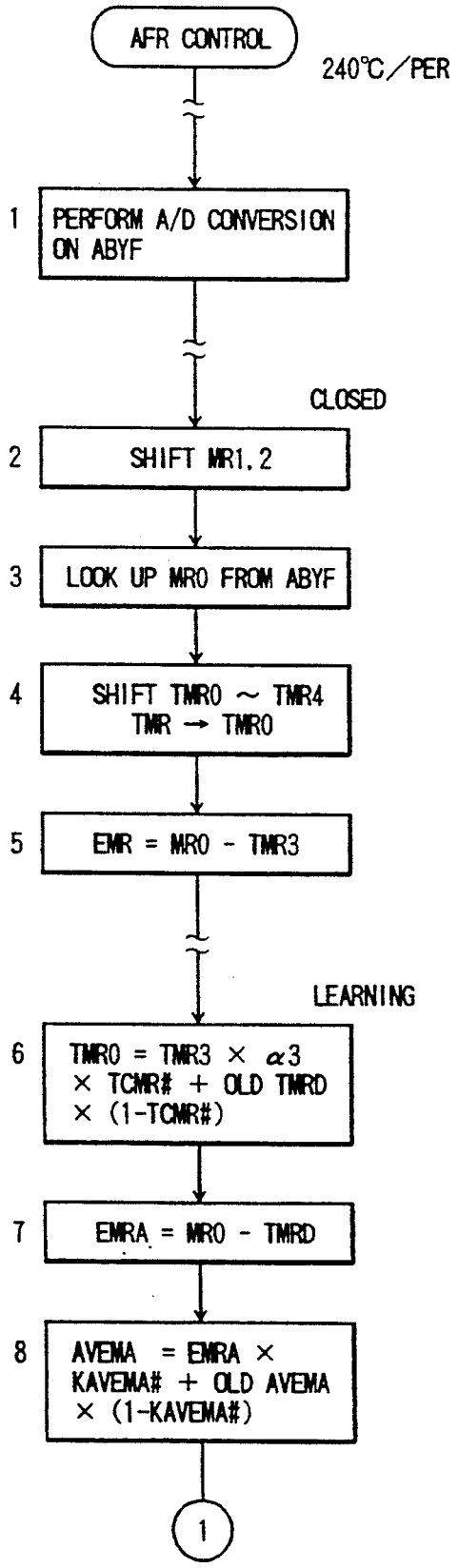
FIGS. 2–10 are flowcharts describing control actions performed by a controller in the first embodiment of this invention.
Figure 3:
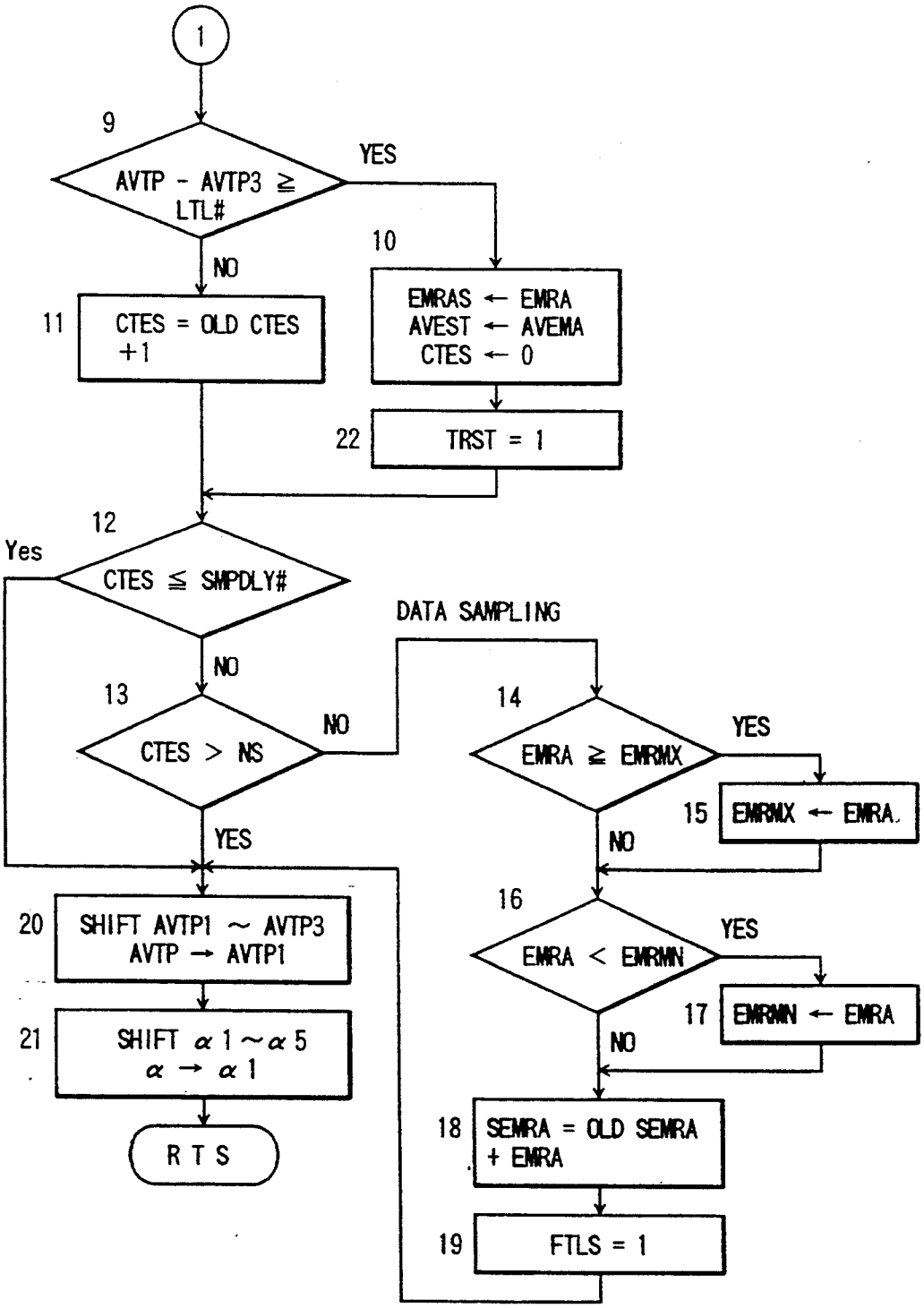

Referring to FIGS. 2 and 3, this data is sampled by converting the output ABYF of the AFR sensor 12 to a real mixing ratio MRO by applying a conversion table in Steps 1–3. The real mixing ratio found on this occasion is then stored in MRO in the memory, and the real mixing ratios found on the two preceding occasions that are shifted respectively into MR1 and MR2 of the memory.

The current value of the target mixing ratio TMR is stored in TMR0 in the memory, and the values on the five preceding occasions are shifted respectively into memories TMR1 to TMR5 (Step 4). The target mixing ratio is predetermined by the parameters, i.e. cooling water temperature TW, pulse width AVTP corresponding to cylinder air intake volume and engine speed N.

After finding the target mixing ratio and real mixing ratio, the mixing ratio error EMR is the difference (or ratio) of the two (Step 5). The target mixing ratio on the third preceding occasion TMR3 is used to find the current real mixing ratio MR0 to allow for the delay from the time when fuel is injected at the intake port to when it reaches the AFR sensor 12 installed in the exhaust gas passage 5. The AFR feedback correction coefficient $\alpha$ is computed based on this EMR in a Step 21.

Under transient conditions, a mixing ratio error during acceleration EMRA (described hereinafter) which is determined by a separate procedure is used instead of this mixing ratio error EMR.

In a Step 6, a target mixing ratio damping value TMRD is determined from the product of the target mixing ratio TMR and the AFR feedback correction coefficient $\alpha$ from the following equation:

$$TMRD = (TMR3 \cdot \alpha 3) \times TCMR\# + old\ TMRD \cdot (1 - TCMR\#)$$

Under transient conditions, this TMRD is used instead of the target mixing ratio TMR. The target mixing ratio TMR and AFR feedback correction coefficient $\alpha$ used here are both values for the third preceding occasion in order to take account of the fuel delay, exhaust gas response and sensor response. TCMR# is a damping coefficient to correct for fuel wall flow and the sensor response.

Next, the mixing ratio error EMRA to be used for transient learning is set equal to the difference between the current real mixing ratio MR0 and the target mixing ratio damping value TMRD (Step 7).

The average value AVEMA is found from this mixing ratio error EMRA from the following equation (Step 8):

$$AVEMA = EMRA \cdot KAVEMA\# + old\ AVEMA \cdot (1 - KAVEMA\#)$$

where KAVEMA# is an averaging coefficient.

This average value is used to eliminate the effect of exhaust gas pulsation and HC, etc., on the real mixing ratio MR0.

In a Step 9, the change in cylinder air volume (AVTP−AVTP3) and transient learning judgment level LTL# are compared. If (AVTP−AVTP3)≧LTL#, it is judged that the engine is accelerating, and the program proceeds to a Step 10.

The mixing ratio error AVEMA at that time is stored in EMRAS in the memory, and the average value AVEMA at that time is stored in AVEST in the memory (Step 10). In other words, the value of mixing ratio error EMRA and the average value of mixing ratio error AVEMA immediately before acceleration are stored in EMRAS and AVEST. AVTP3 is the value of AVTP on the third preceding occasion.

At times other than during acceleration, the counter value CTES of the data sampling number is increased (Step 11). If this value CTES is greater than a predetermined value SMPDLY#, the program proceeds to data sampling in a Step 14 and subsequent steps. SMPDLY# determines the data sampling delay from the variation of AVTP.

In data sampling, the mixing ratio error EMRA during sampling is compared with the values stored in the memories EMRMX and EMRMN. If EMRA≧EMRMX, the mixing ratio error is stored in EMRMX, conversely if EMRA<EMRMN, the mixing ratio error is stored in EMRMN (Steps 14–17). The maximum value of the mixing ratio error is therefore stored in EMRMX, and the minimum value of the mixing ratio error is stored in EMRMN.

The mixing ratio error EMRA is also integrated in order to determine the mixing ratio error area SEMRA (Step 18).

Two flags (TRST and FTLS) are set during data sampling (Steps 19, 22), however whereas TRST is set only at the start of data sampling, FTLS is set throughout the whole transient learning process.

If the counter value CTES exceeds a data sample number NS (Step 13), data sampling is terminated, and the data in the memories is then shifted (Steps 20, 21).

In this manner, the mixing ratio error before acceleration EMRAS, the maximum value of mixing ratio error EMRMX and the minimum value of mixing ratio error EMRMN are sampled.

Figure 4:
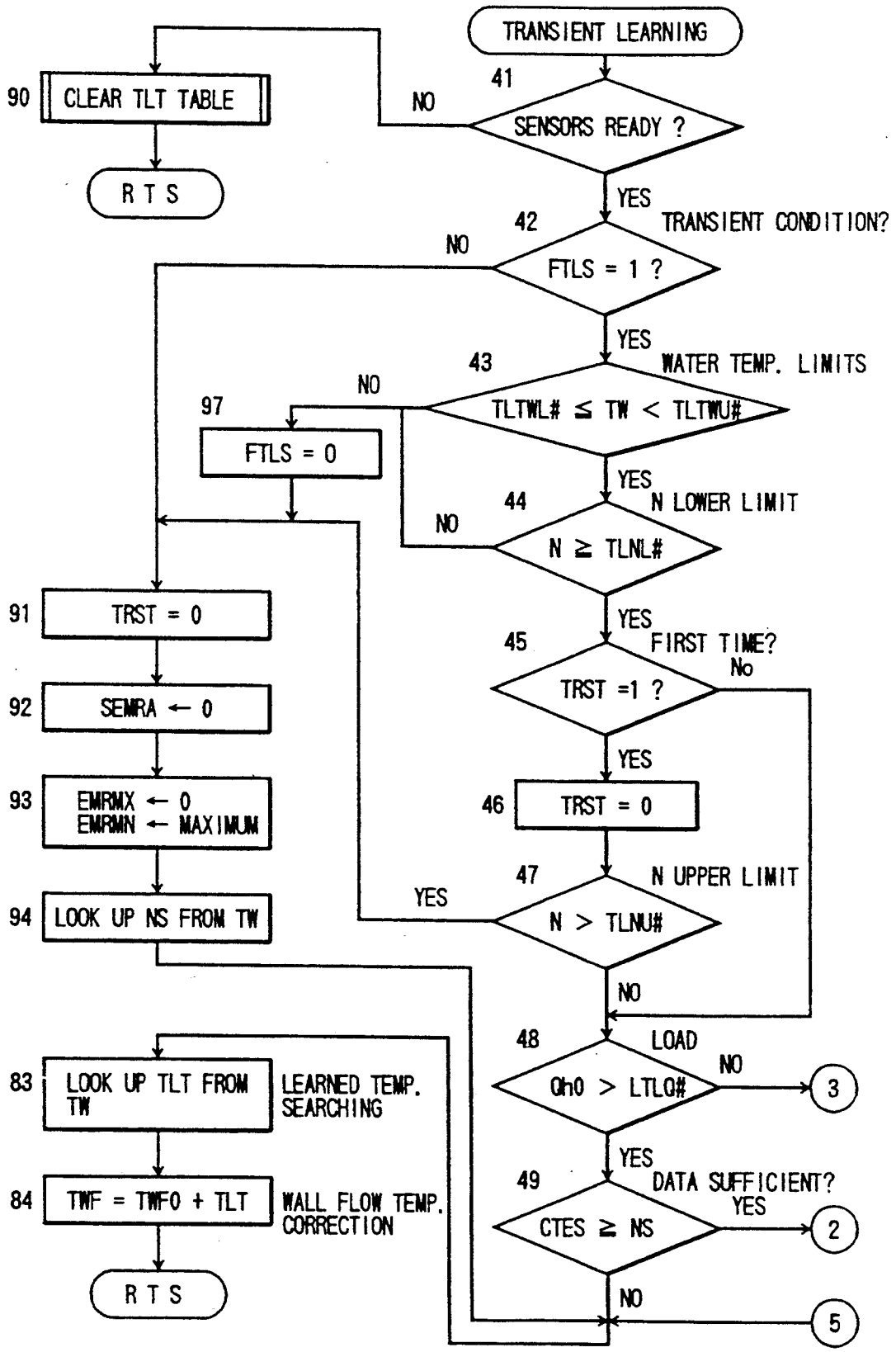
Figure 5:
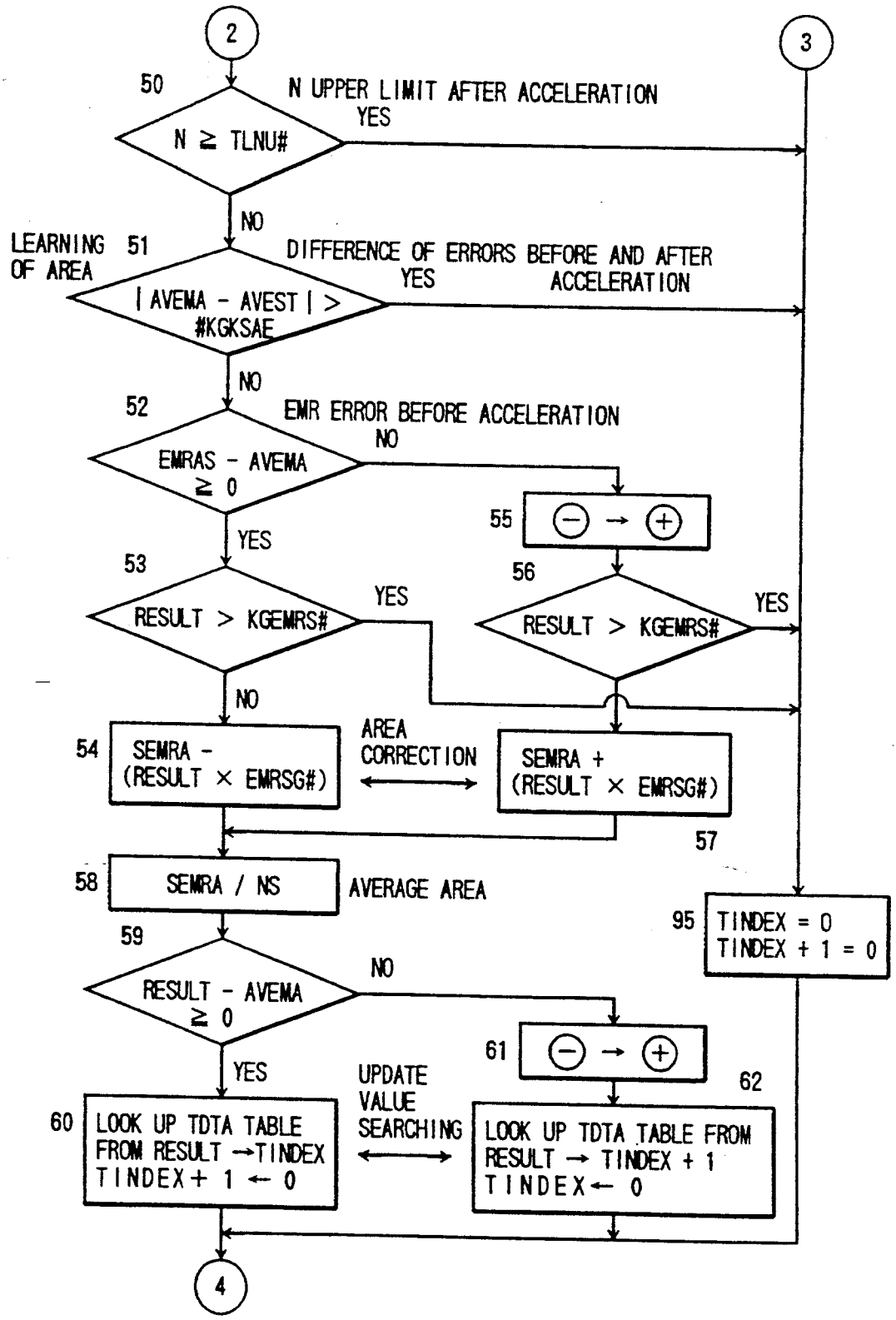
Figure 6:
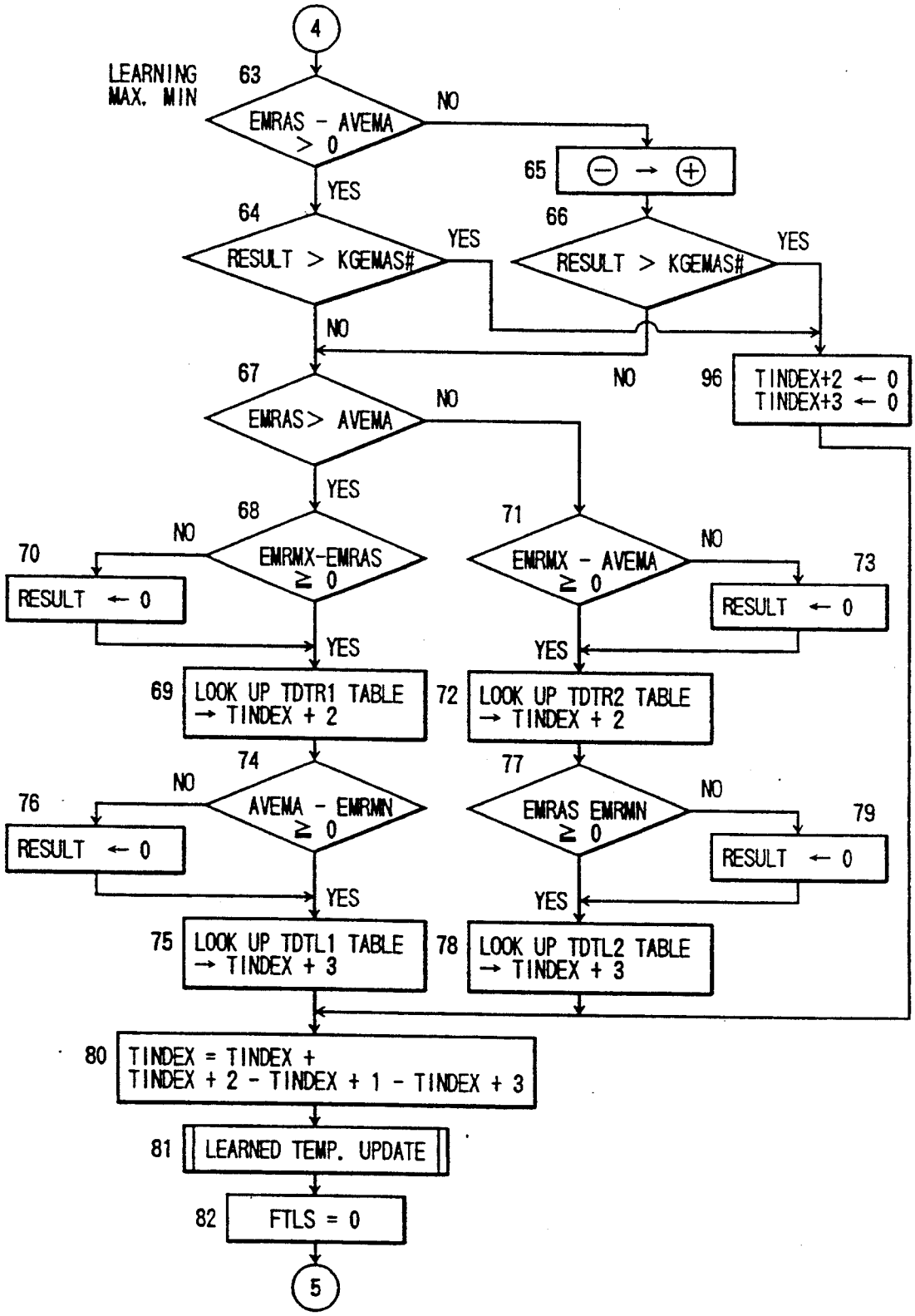

Transient learning will now be described with reference to FIGS. 4–6. First, in Steps 41 and 90, it is judged whether or not there is a fault in the sensors related to the learning process (e.g. the air flow meter, throttle opening sensor, water temperature sensor and crank angle sensor), and if there is a fault, a TLT table stored in a back-up memory is cleared.

TLT is a learning temperature which corresponds to the wall flow temperature prediction value TWF described hereintofore, and it is assigned to the water temperature TW. This table is also cleared in an initialization routine if the learned values are not normal.

In Steps 42–50, it is judged whether or not the learning conditions are established. If the following six conditions are satisfied, the program proceeds to transient learning in a Step 51 and subsequent steps:

(1) FTLS=1, i.e. the engine is accelerating (Step 42).

(2) The water temperature TW lies within a predetermined temperature range (TLTWL#≦TW<TLTWU#) (Step 43). As an example, the lower limit of water temperature TLTWL# may be 20C, and the upper limit TLTWU# may be 85C.

(3) The engine speed N lies within a predetermined range (TLNL#≦N≦TLNU#) (Steps 44, 47). As an example, the lower limit of engine speed TLNL# may be 1000 rpm, and the upper limit TLNU# may be 3000 rpm.

(4) The engine load is above a predetermined value (Qh>LTLQ#) (Step 48). LTLQ# is the lower limit of the load. This condition is set in order to stop learning when the accelerator pedal is returned to its original position during acceleration.

(5) All data sampling has been completed (Step 49).

(6) The engine speed N does not exceed the aforesaid upper limit TLNU# even after the end of the sampling period (Step 50).

If the difference |AVEMA−AVEST| of the average value of mixing ratio error before and after acceleration exceeds a predetermined value KGKSAE, there is probably an excessive steady state error and learning is therefore not performed (Steps 51, 95).

If the aforesaid conditions are satisfied, learning of the mixing ratio error area and learning of the maximum and minimum values of mixing ratio error are performed concurrently.

First, insofar as concerns the mixing ratio error area, the mixing ratio error area SEMRA is corrected before learning (Steps 52–57). This correction compensates for the response delay in the mixing ratio error after acceleration AVEMA. If the mixing ratio error before acceleration EMRAS is greater than the average value of mixing ratio error after acceleration AVEMA, the product of the difference and a correction gain EMRSG# is subtracted from SEMRA. If on the other hand EMRAS is less than AVEMA, the product of the difference (absolute value) and EMRSG# is added to SEMRA.

If the difference between the mixing ratio error before acceleration EMRAS and the average value of mixing ratio error after acceleration AVEMA exceeds a predetermined value KGEMRS#, the above compensation is not made (Steps 53, 56, 95).

Next, the compensated mixing ratio error area SEMRA is divided by the data sampling number NS to find a mixing ratio error area height (Step 58), and this height (SEMRA/NS) is compared with the average value of mixing ratio error after acceleration AVEMA (Step 59).

If (SEMRA/NS)≧AVEMA, a learned updating value relating to the mixing ratio error area is searched from a TDTA table according to the difference of these values, and stored in TINDEX (°C.) of the working memory (Step 60). Similarly, if (SEMRA/NS)<AVEMA, a learned updating value is searched according to the difference (absolute value) from the TDTA table, and stored in TINDEX+1 (°C.) of the working memory (Steps 61, 62).

Insofar as concerns the maximum and minimum values of mixing ratio error, if the difference between the mixing ratio error before acceleration EMRAS and the average value of mixing ratio error after acceleration AVEMA exceeds a predetermined value KGEMAS#, it is deemed that the steady state errors are too large and learning is not performed (Steps 63–66, 96).

If on the other hand the steady state errors lie within a range that can be covered by learning, the program proceeds to a Step 67 and subsequent steps.

If (i) the mixing ratio error before acceleration EMRAS is greater than the average value of mixing ratio error after acceleration AVEMA, and the maximum value of mixing ratio error EMRMX is greater than the larger of the two (Case B in FIG. 16), or (ii) if the average value of mixing ratio error after acceleration AVEMA is greater than the mixing ratio error before acceleration EMRAS, and the maximum value of mixing ratio error EMRMX is greater than the larger of the two (Case D in FIG. 16), a learned updating value relating to the maximum value of mixing ratio error is searched according to the final surplus from Table TDTR1 or TDTR2, and the result is stored in TINDEX+2 (°C.) of the working memory (Steps 67–69, Steps 67, 71, 72).

If (iii) the average value of mixing ratio error after acceleration AVEMA is less than the mixing ratio error before acceleration EMRAS and the minimum value of mixing ratio error EMRMN is smaller than the smaller of the two (Case A in FIG. 16), or (iv) if the mixing ratio error before acceleration EMRAS is less than the average value of mixing ratio error after acceleration AVEMA and the minimum value of mixing ratio error EMRMN is smaller than the smaller of the two (Case C in FIG. 16), a learned updating value relating to the minimum value of mixing ratio error is searched according to the final deficit from Table TDTR1 or TDTR2, and the result is stored in TINDEX+3 (°C.) of the working memory (Steps 67, 74, 75, Steps 67, 77, 78).

The mixing ratio error after acceleration EMRA may also be used instead of the average value of mixing ratio error before acceleration AVEMA.

The contents of the tables TDTR1, TDTR2 and the tables TDTL1, TDTL2 are shown in FIG. 12–FIG. 15. It is seen that as the surplus or deficit on the horizontal axis increases, the learned updating value also increases. An upper limit and a dead zone are assigned to the learned updating values so that learning is not subject to abrupt fluctuations. Also, as lean peaks have a greater effect on driveability than rich peaks, TINDEX+3 is given a larger value than TINDEX+2.

After finding learned updating values for mixing ratio error area, the maximum value of mixing ratio error and the minimum value of mixing ratio error, they are summed, and a learning temperature (value from TLT table) is updated by the total learned updating value TINDEX (°C.) (Steps 80, 81). This learning value may moreover be updated by for example 4 point learning or 2 point learning based on the water temperature TW.

The learning temperature TLT (°C.) is searched from the water temperature TW. The aforesaid wall flow temperature prediction value TWF is then set equal to a basic wall flow temperature prediction value TWFO (°C.), and the value obtained by adding the learning temperature TLT to this TWFO is then again set equal to the wall flow temperature prediction value TWF (°C.) (Step 84). In the case shown in FIG. 17, for example, by setting the learning temperature TLT and the apparent wall flow temperature prediction value low, the aforesaid transition correction amount Kathos is increased, and lean peaks are smoothed out.

In this embodiment, lean peaks (i.e. minimum values of mixing ratio error) are sampled, and the amount (EMRAS−EMRMN) below the mixing ratio error before acceleration is taken as a learned updating value. Even if a fixed error remains in the mixing ratio error after acceleration, therefore, it is eliminated by setting the mixing ratio error before acceleration as a lower limit and the mixing ratio after acceleration as an upper limit, and taking the amount by which the mixing ratio falls when it falls beneath this range as a lean error. Also, in the Cases B and D shown in FIG. 16, the fixed error can be eliminated when rich peaks are above an upper limit by taking the amount above the limit as a rich error.

By eliminating transient errors and steady state errors in this way, learning efficiency does not decline even if the injector or air flow meter has some performance scatter or deterioration, and instantaneous lean or rich peaks are suppressed. Stumbling or hesitation is therefore prevented.

In this embodiment, both the minimum and maximum values of the mixing ratio error are learned, but it will be understood that stumbling or hesitation can be adequately prevented even if only one of them is learned. This invention can also be applied in a similar way during engine deceleration, and to single point injection systems.

Figure 18:
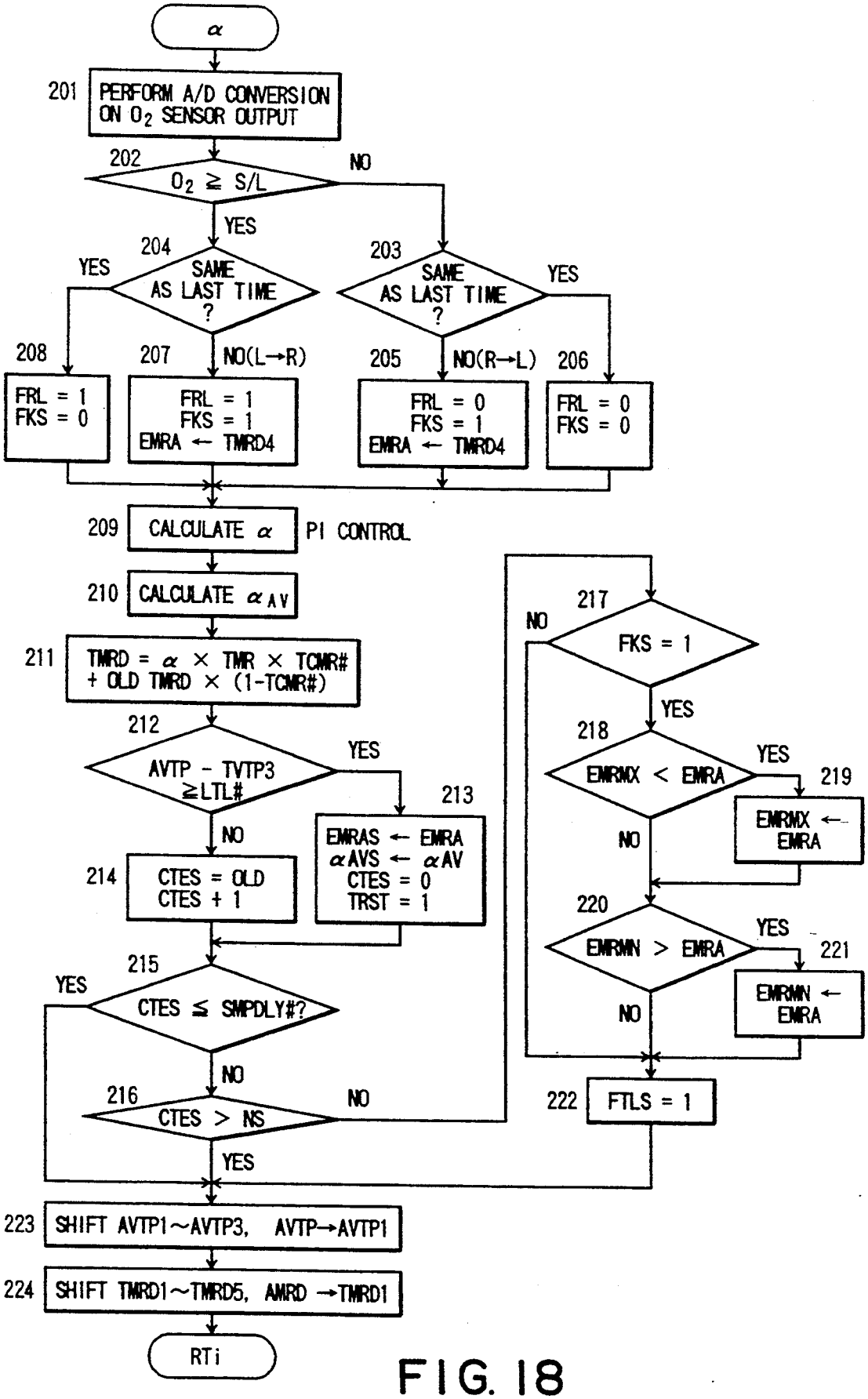
FIG. 18 is a flowchart describing the sampling of mixing ratio error used in a second embodiment of this invention.

Next, FIG. 18 illustrates a second embodiment of this invention.

In this embodiment, an $O_2$ sensor is used instead of the AFR sensor 12. The $O_2$ sensor responds to oxygen concentration in the same way as the AFR sensor, but instead of the output varying in response to the oxygen concentration in the exhaust gas, the output varies sharply at the theoretical AFR (mixing ratio).

The $O_2$ sensor can detect only whether the mixing ratio is on the rich or lean side, and cannot detect the actual AFR.

The controller 20 samples values of AFR feedback correction coefficients $\alpha$ (or of coefficients TMRD found by carrying out a certain process on $\alpha$) when the output of the $O_2$ sensor varies sharply, i.e. when the real AFR crosses the theoretical AFR, and performs transient learning using this sampling data.

Referring to FIG. 18, the output of the $O_2$ sensor is first compared to a slice level S/L corresponding to the theoretical AFR, and by comparing the result with the result of the immediately preceding comparison, it is judged whether or not the output of the $O_2$ sensor has crossed the theoretical AFR. When there is a changeover from rich to lean or vice versa, the value of a flag FKS is set equal to "1", and a target mixing ratio damping value TMRD at that time is stored in the memory EMRA (Steps 202, 203, 205, 202, 204, 207).

The target mixing ratio damping value TMRD is a value obtained by performing the following process (damping process) on the product of the target mixing ratio TMR and the AFR feedback correction coefficient $\alpha$ as follows:

$$TMRD=(TMR\cdot\alpha)\cdot TCMR\#+old\ TMRD\cdot(1-TCMR\#)$$

where TCMR# is a damping coefficient.

This takes account of the delay of fuel wall flow until fuel injected into the intake passage 3 reaches the cylinder, and of the delay in the response of the $O_2$ sensor itself.

TMRD actually corresponds to the target mixing ratio, and when the real mixing ratio MR can be computed (when using an AFR sensor), the difference between the two may be set equal to the mixing ratio error EMRA (=MR−TMRD). Here, however, as AFR sensor is not used, the value of TMRD when the output of the $O_2$ sensor crosses the theoretical AFR is taken as the real mixing ratio error EMRA (Steps 205, 207). As the magnitude of $\alpha$ as a control quantity is inverse to that of the real mixing ratio, the magnitude of TMRD which has the same symbols is also inverse to that of the real mixing ratio. Unlike the case of the AFR sensor, therefore, the magnitude of the real mixing ratio error EMRA is inverted.

In order to take account of the time delay until the fuel injected into the intake passage 3 burns and reaches the $O_2$ sensor in the exhaust passage 5, the value of TMRD4 (on the fourth preceding occasion) is stored (Steps 205, 207).

Constant values are assigned to proportional and integral parts of the AFR sensor feedback correction coefficient α irrespective of the magnitude of errors, so as to compute the coefficient α and calculate an average value α AV during a half cycle of α when the output of the $O_2$ sensor cuts the theoretical AFR (Steps 209, 210).

Next, in a Step 212, the cylinder air volume change (AVTP−AVTP3) and a transient learning judgment level LTL# are compared. If (AVTP−AVTP3)≧LTL#, it is judged that the engine is accelerating and the program proceeds to a Step 213. AVTP3 is the value of AVTP on the third preceding occasion. The mixing ratio error EMRA is stored in EMRAS in the memory, and the value of α AV at that time is stored in α AVS in the memory. The mixing ratio error and the average value during a half cycle of α immediately before acceleration are thus stored respectively in EMRAS and α AVS.

The pulse width AVTP corresponding to the cylinder intake volume is the value of the weighting average of TP smoothed by the coefficient Fload according to the aforesaid relation:

$$AVTP = Tp \cdot Fload + old\ AVTP \cdot (1 - Fload)$$

Immediately after acceleration, the count value CTES of the data sample number is increased (Step 214), and if this value CTES exceeds a predetermined value SMPDLY#, the program proceeds to data sampling in a Step 217 and subsequent steps. SMPDLY# determines the data sampling delay from the variation of AVTP.

Data sampling is performed only when the output of the $O_2$ sensor crosses the theoretical AFR, i.e. when FKS=1. The maximum value of mixing ratio error EMRA is then held in EMRMX, and the minimum value of the mixing ratio error EMRA is held in EMRMN, in the memory (Steps 217–221).

During data sampling, two flags (TRST and FTLS) are set (equal to "1") (Steps 213, 222), however whereas TRST is set only at the start of learned data sampling, FTLS is set throughout the whole transient learning process.

If the counter value CTES exceeds a data sampling number NS (Step 216), data sampling is terminated. The current target mixing ratio error damping value TMRD is stored in TMRD1, and the values starting from that obtained on the immediately preceding occasion to that obtained on the fifth preceding occasion are shifted respectively into TMRD2 to TMRD6 (Step 224). Data stored in the memory concerning AVTP is also shifted (Step 223).

In this way, high precision learning is achieved even if an $O_2$ sensor, which can discriminate only when the AFR is rich or lean, is used. Moreover, by using a target mixing ratio damping value which is delayed by several cycles, the effect of delay in the fuel supply to the combustion chamber due to wall flow and of response delay in the sensor itself is eliminated, and learning precision is further improved.

FIG. 19–24 describe a third embodiment using another technique to separate transient errors and fixed errors during transient learning.

In this embodiment, the controller 20: (1) stores the extent of acceleration/deceleration and the mixing ratio error at the time in the memory for certain numbers of samples, (2) determines the slope of the correlation between the two, and (3) updates transient learned values such that the slope becomes a target value.

Firstly, the extent of acceleration/deceleration is expressed as a value obtained by dividing the total fuel supplied in one combustion cycle by a target fuel amount.

Figure 19:
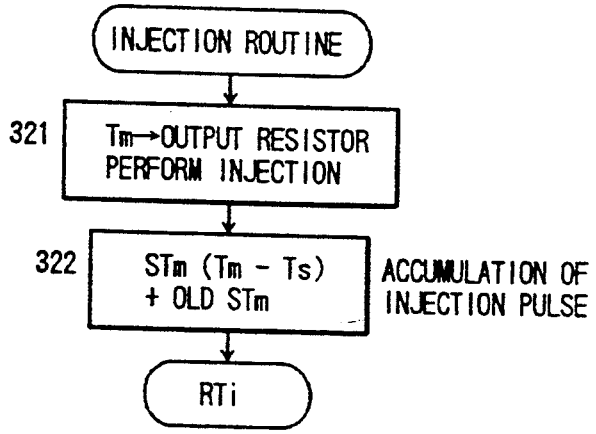
FIG. 19 is a flowchart describing the integration of fuel injection pulse width in a third embodiment of this invention.

As shown in FIG. 19 for example, in a cylinder of injector number [m], a fuel injection pulse Tm calculated for this cylinder (the aforesaid synchronous injection pulse width Tin or asynchronous injection pulse width Injsetn) is shifted to an output resistor, and an injection is performed in synchronism with the injection timing. The effective pulse widths (Tm−Ts) for each injections are summed, and the resulting integral is stored in STm in the memory (Step 322).

Figure 20:
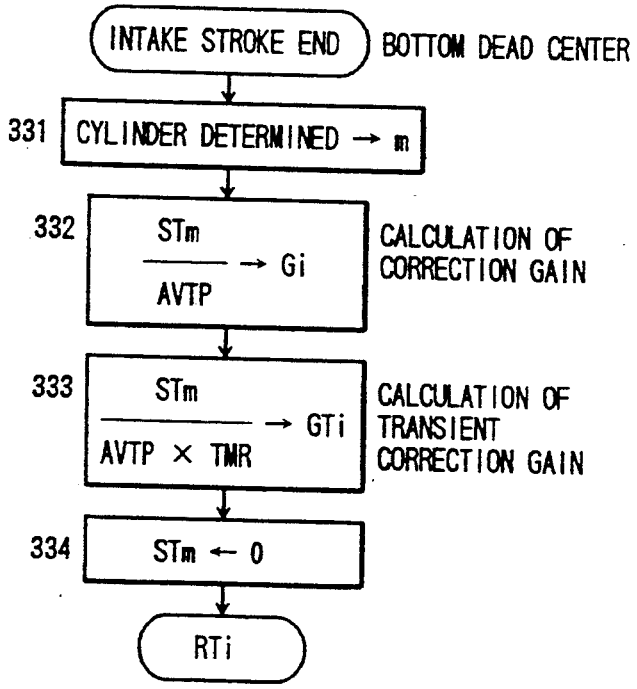
FIG. 20 is a flowchart describing the calculation of transient correction gain in the third embodiment of this invention.

As shown in FIG. 20, at a certain time for the cylinder having an injector number [m] (in the vicinity of the bottom dead center of an intake cycle), the integral value STm at that time is divided by AVTP·TMR (corresponding to the target fuel injection pulse width), the result is designated as a transient correction gain, and is stored in GTi in the memory (Step 333).

During acceleration and increased fuel injection, GTi>1, while during deceleration and decreased fuel injection, GTi<1, where GTi represents the degree of transiency.

When asynchronous injection is not being performed, (AVTP+Kathos)/AVTP can also be set equal to the transient correction gain GTi.

Figure 21:
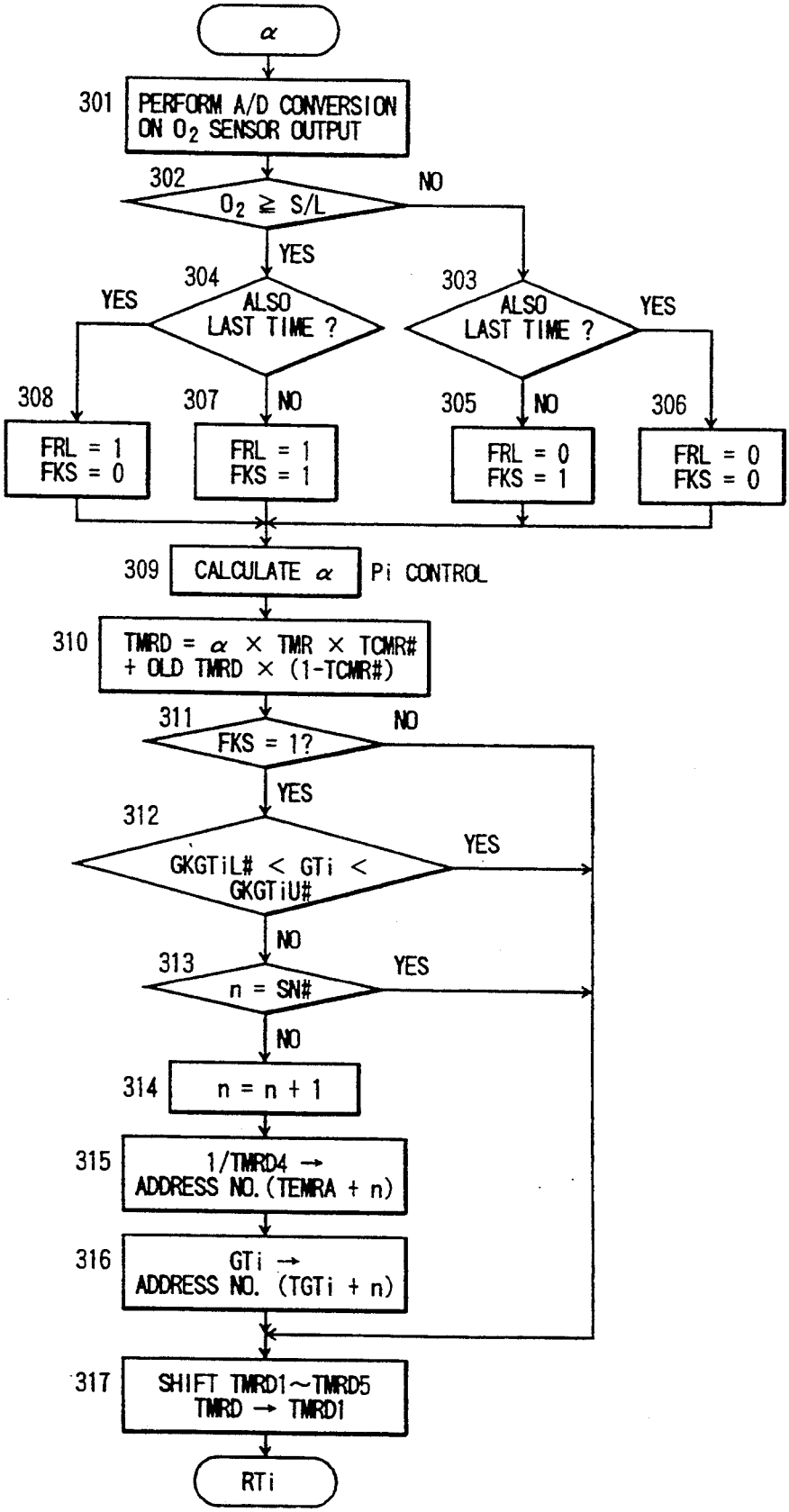
FIG. 21 is a flowchart describing data sampling of the mixing ratio error in the third embodiment of this invention.

Next, the data sampling of the mixing ratio error will be described by means of FIG. 21.

Firstly, the output of the $O_2$ sensor is compared to a slice level corresponding to the theoretical AFR, and by comparing the result with the result obtained on the immediately preceding occasion, the time when the $O_2$ sensor output crosses the theoretical AFR (i.e. when it changes over from rich to lean and vice versa) is detected, and the value of the flag FKS is set equal to "1" (Steps 302, 303, 305, and Steps 302, 304, 307).

Constant values are then assigned to proportional parts and integral parts of the AFR feedback correction coefficient α irrespective of the magnitude of errors so as to compute the coefficient α (Step 309).

By smoothing the product of the computed α and target mixing ratio error TMR with a damping coefficient TCMR#, a target mixing ratio damping value TMRD (Step 310) is found. This takes account of the delay of fuel wall flow until fuel injected into the air intake passage reaches the cylinder, and of the delay in the response of the $O_2$ sensor itself.

When the output of the $O_2$ sensor crosses the slice level, i.e. when FKS=1, the program proceeds to data sampling in a Step 12 and subsequent steps (Step 311).

If the transient correction gain GTi lies within a predetermined range having a lower limit of GKGTiL# and an upper limit of GKGTiU# (GKGTiL#<GTi<GKGTiU#), it is judged that the engine is in a steady state and sampling is not performed (Step 312). Sampling is performed only in a transient state as it is not desired to increase memory capacity.

If the sampling number n is less than a total sampling number SN#, the reciprocal of TMRD when the output of the $O_2$ sensor crosses the theoretical AFR is stored in EMRA in the memory, and then EMRA, i.e. the mixing ratio error, is further shifted to an address (TEMRA+n). The reciprocal of TMRD may also be placed directly in an address (Step 315).

EMRA>1 indicates a rich error, and EMRA<1 indicates a lean error.

The transient correction gain GTi corresponding to the mixing ratio error EMRA is stored in an address (TGTi+n) of the memory (Step 316). TGTi and TEMRA are the leading addresses.

Storage of these two parameters (mixing ratio error EMRA and transient correction gain GTi) in addresses is repeated until the sample number n (initialization number) reaches SN#−1. When n=SN#, data sampling is terminated (Steps 313, 314).

When data sampling is terminated, the target mixing ratio error damping value TMRD is stored in TMRD 1, and the values starting from that obtained on the immediately preceding occasion to that obtained on the fifth preceding occasion are shifted respectively into TMRD2 to TMRD6 (Step 317). TMRD5 and TMRD6 are required only when the $O_2$ sensor is installed at a downstream position in the exhaust passage.

Figure 22:
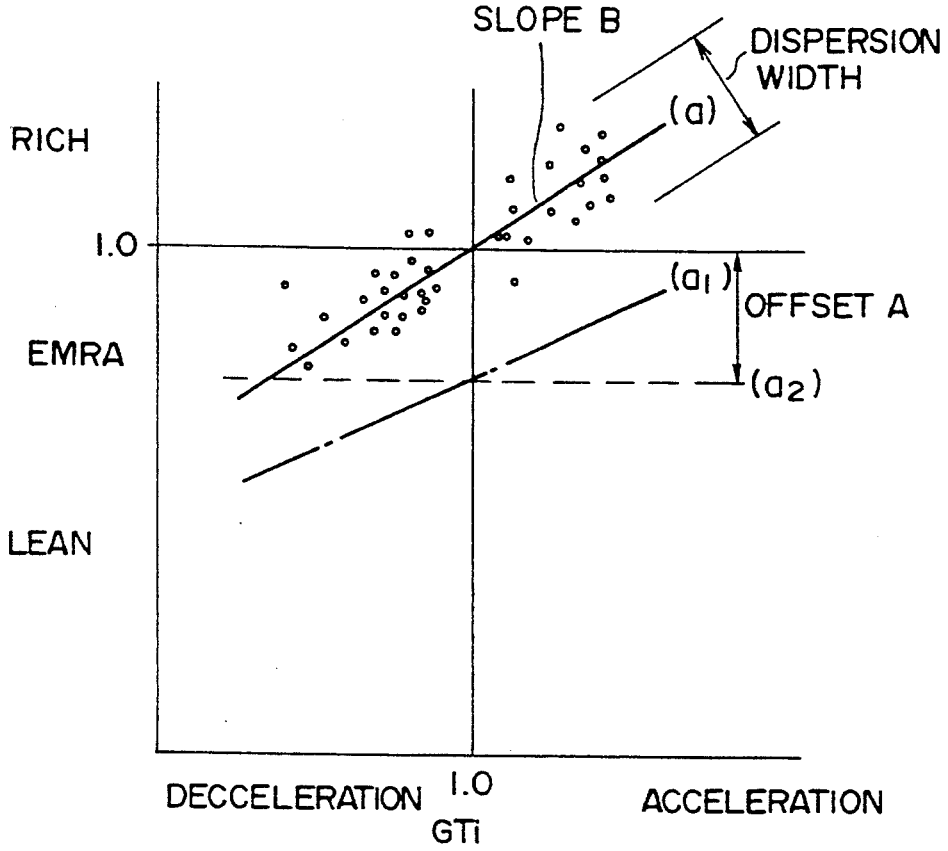
FIG. 22 is a graph showing data sampled in the third embodiment of this invention.

As shown in FIG. 22, a plot of the SN# data pairs thus obtained is close to a straight line (a) with some scatter.

The slope B of this straight line (a) represents the transient error. Further, when the line (a) is offset as in ($a_1$), this offset A represents a fixed error. In other words, if the relation between the mixing ratio error EMRA and transient correction gain GTi is represented graphically, transient errors and steady state errors can be completely separated.

The slope B and offset A of the line can be found from a first order regression.

Figure 24:
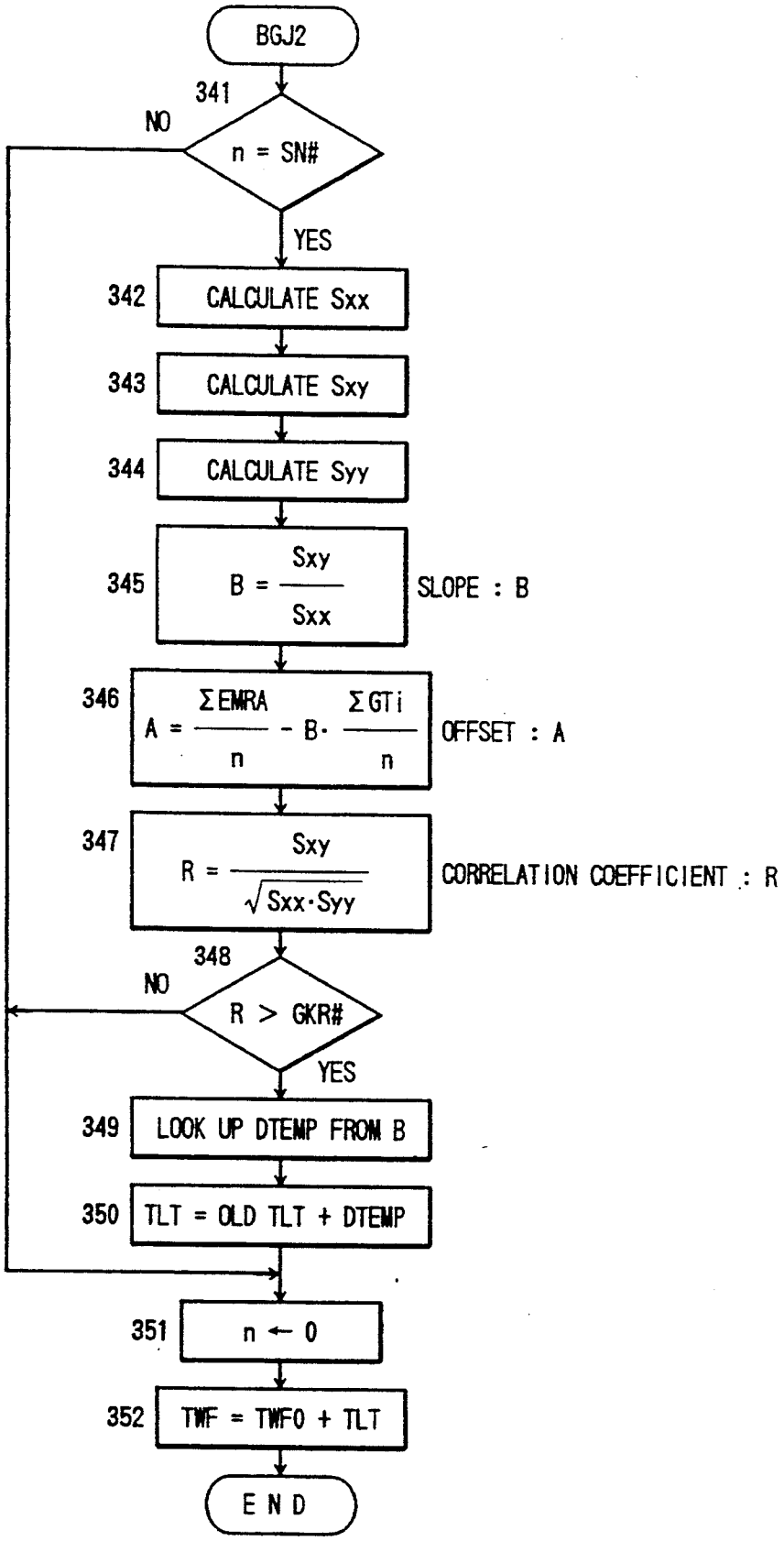
FIG. 24 is a flowchart describing the updating of learned values in the third embodiment of this invention.

This calculation is known in the art. As shown in FIG. 24, if Sxx, Sxy, Syy are represented by the following expressions (1)–(3), Sxy/Sxx is equal to the slope B, and the offset A can be found from expression (4) (Steps 342–346):

$$Sxx=\Sigma GTi^2-\{(\Sigma GTi)^2/n\} \quad (1)$$

$$Sxy=\Sigma(GTi\cdot EMRA)-(\Sigma GTi\cdot\Sigma EMRA/n) \quad (2)$$

$$Syy=\Sigma EMRA^2-\{(\Sigma EMRA)^2/n\} \quad (3)$$

$$A=(\Sigma EMRA/n)-\{B\cdot(\Sigma GTi)/n\} \quad (4)$$

As shown by the line (a) in FIG. 22, too much fuel is supplied when there is a rich error during acceleration or a lean error during deceleration. If however learned values are updated such that the slope B of the line (a) is effectively 0 (target value), rich errors during acceleration and lean errors during deceleration can be eliminated.

The correlation coefficient T computed from the following expression (5) indicates a stronger correlation the closer it is to 1:

$$R = Sxy/\sqrt{Sxx\cdot Syy} \quad (5)$$

If this correlation coefficient is less than a predetermined value GKR# between 1 and 0.5, there is a large scatter (i.e. no correlation), and learning is not performed (Steps 347, 348).

If R>GKR#, learned updating amounts DTEMP (°C.) are searched from a DTEMP table according to the slope B. These values are added to the learned temperature TLT (°C.) so as to update values in a table (TLT table) of learned values assigned to the cooling water temperature TW (Steps 349, 350).

The aforesaid wall flow temperature prediction value TWF is replaced by a basic wall flow temperature prediction value TWFO (°C.), and the result of adding this to the learned value TLT is then set equal to the new wall flow temperature prediction value TWF (°C.) (Step 352). The transient correction quantity Kathos is calculated from this prediction value TWF as described hereintofore.

Figure 23:
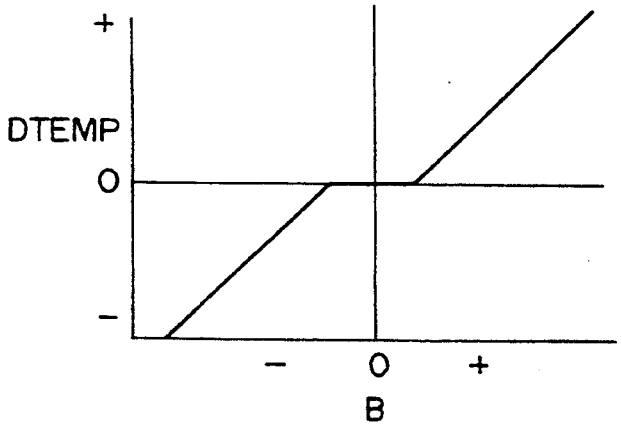
FIG. 23 is a graphical representing of the contents of a DTEMP table used in the third embodiment of this invention.

FIG. 23 shows the contents of the aforesaid DTEMP table. As shown in the figure, if B>0 (when there is a rich error during acceleration or a lean error during deceleration), and a positive value is assigned to the learned updating amount DTEMP so as to increase the learned temperature TLT, the apparent wall flow temperature prediction value TWF also increases. The transient correction quantity Kathos is then decreased, and rich errors during acceleration can be eliminated.

If on the other hand B<0, and a negative value is assigned to DTEMP so as to decrease the learned temperature TLT. Lean errors during acceleration and rich errors during deceleration can therefore also be eliminated.

A dead zone is also assigned to the region where B is small so that learning is not subject to abrupt fluctuations.

The action of this third embodiment of the invention will now be described with reference to FIG. 22.

Even if there are no steady state error when matching is carried out at the beginning, fuel supply may be inadequate and a lean error may remain under steady state conditions if the injector should become clogged due to performance scatter or deterioration. It is assumed that in this case there are no transient errors.

If learning of the mixing ratio error area is performed in the transient period (sampling period) under these conditions, steady state errors cannot be separated and learning precision declines.

On the other hand, if in this embodiment there is only a steady state lean error, there is no slope B and the offset amount A shifts to less than 1 as shown by the straight line ($a_2$) in FIG. 22. As B=0, the learned temperature TLT is not updated and therefore the steady state error has no effect.

If, for example, a rich error occurs during acceleration in addition to this steady state error, a positive slope B appears as shown by the straight line ($a_1$) in FIG. 22. Updating is then performed so as to increase the learned temperature TLT only by an amount corresponding to the slope B, the transient correction amount Kathos is decreased, and the rich error during acceleration can be eliminated.

Stated differently, in this embodiment, by finding the slope B and the offset A from the correlation between the transient correction gain GTi which expresses the degree of transiency and the mixing ratio error EMRA, the transient error (represented by the slope B) and the steady state error (represented by the offset A) can be completely separated, and therefore the decline of the precision of transient learning due to the effect of the steady state error does not occur. Further, since learning is performed based on only the transient error without the steady state error, the precision of transient learning is increased.

Figure 25:
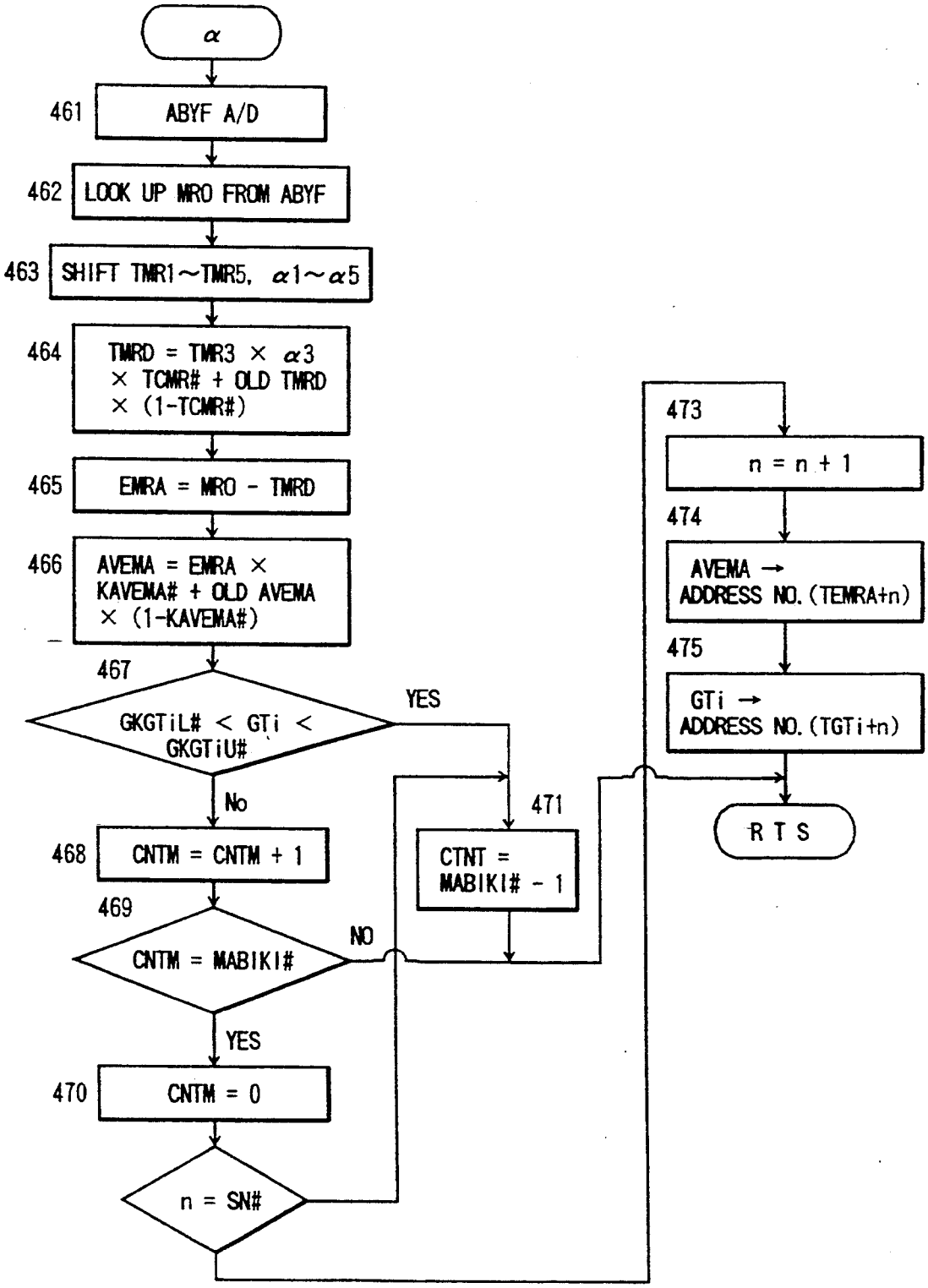
FIG. 25 is a flowchart describing data sampling of mixing ratio error in a fourth embodiment of this invention.

FIG. 25 illustrates a fourth embodiment wherein this transient learning method is applied to an AFR controller provided with a similar AFR sensor to that of the first embodiment instead of the $O_2$ sensor. In this case, data sampling of the mixing ratio error is somewhat different to that in the third embodiment as shown in Steps 461–466 due to the difference in the detection precision.

The AFR sensor output ABYF is for example converted to a real mixing ratio MRO using a mixing ratio conversion table (Step 461). This real mixing ratio is then stored in MRO in the memory (Step 462).

The current value of the target mixing ratio TMR is on the other hand stored in TMRO in the memory, and the values starting from that obtained on the immediately preceding occasion to that obtained on the fifth preceding occasion are shifted respectively into TMRD1 to TMRD5 (Step 463). The current value of the AFR feedback correction coefficient $\alpha$ is also stored in $\alpha 1$ in the memory, and the values starting from that obtained on the immediately preceding occasion to that obtained on the fifth preceding occasion are shifted respectively into $\alpha 2$ to $\alpha 6$ (Step 463).

The target mixing ratio damping value TMRD is found from the product of the target mixing ratio and the AFR feedback correction coefficient $\alpha$ (Step 464). The values of TMR and $\alpha$ on the third preceding occasion are used in order to take account of the simple delay time from fuel injection to detection of the real mixing ratio by the AFR sensor.

The mixing ratio error EMRA is actually a value obtained by dividing the real mixing ratio MRO by the target mixing ratio damping value TMRD. When the error itself has a value close to 1, it can be approximated by the difference between the two (Step 465). This approximation speeds up the computation.

The average value AVEMA is also found from the mixing ratio error EMRA using the averaging coefficient KAVEMA (step 466).

The average value of mixing ratio error AVEMA is used here instead of the mixing ratio error EMRA in the third embodiment (Steps 467, 472, 473–475). The real mixing ratio MRO fluctuates due to the effect of exhaust gas pulsation and HC, etc., and by using the average value this effect can be avoided.

As an AFR sensor is used in this embodiment, the precision of mixing ratio error data is higher than in the third embodiment. Consequently, if for example there are 5 interpolation numbers MABIKI#, memory capacity can be further reduced by performing data sampling only once in 5 times (Steps 468–471).

In this embodiment, the AFR feedback correction coefficient $\alpha$ can be used instead of the mixing ratio errors (EMRA and AVEMA), however in this case the scatter shown in FIG. 22 may be somewhat wider.

The foregoing description of the preferred embodiments for the purpose of illustrating this invention is not to be considered as limiting or restricting the invention, since many modifications may be made by those skilled in the art without departing from the scope of the invention.

The embodiments of this invention in which an exclusive property or privilege is claimed are defined as follows:

We claim:

1. An air-fuel ratio controller for an engine having a combustion chamber, an air intake passage for supplying air to said chamber and a fuel injector for injecting fuel into said intake passage, comprising:

means for calculating a target mixing ratio based on engine running conditions, means for detecting a real mixing ratio of fuel and air supplied to said combustion chamber, means for detecting a difference between the real mixing ratio and the target mixing ratio as a mixing ratio error, means for computing a mixing ratio feedback correction coefficient for feedback correction of an injection fuel amount based on the mixing ratio error, means for applying a correction to the injection fuel amount based on the feedback correction coefficient, means for detecting whether the engine is in a transient running state, a memory for continuous storage of mixing ratio errors in the transient running state, means for sampling a peak value of said mixing ratio errors in the transient running state, means for sampling a first mixing ratio error when the engine is judged to be in the transient running state as a pre-transient error, means for sampling a last mixing ratio error when the engine is judged to be in the transient running state as a post-transient error, means for finding whichever of said pre-transient mixing ratio error and post-transient mixing ratio error is nearer to said peak value, means for computing a difference between said mixing ratio error found and said peak value, means for computing an injection fuel correction amount in the transient running state so as to eliminate this difference, a memory for storing said computed correction amount as a learned value, and means for correcting the injection fuel amount in the transient running state based on a previously learned value.

2. An air-fuel ratio controller as defined in claim 1, wherein said real mixing ratio detection means comprises an air-fuel ratio sensor for directly detecting the air-fuel ratio from the engine exhaust gas composition, and means for converting the air-fuel ratio to the mixing ratio.

3. An air-fuel ratio controller as defined in claim 1, wherein said real mixing ratio detection means comprises an $O_2$ sensor of which the output varies sharply at the theoretical air-fuel ratio in response to the engine exhaust gas composition, means for judging whether or not the $O_2$ sensor output has varied sharply, and means for computing the real mixing ratio from the target mixing ratio and the feedback correction coefficient when the $O_2$ sensor output has varied sharply.

4. An air-fuel ratio controller as defined in claim 1, wherein said real mixing ratio detection means comprises an $O_2$ sensor of which the output varies sharply at the theoretical air-fuel ratio in response to the engine exhaust gas composition, means for judging whether or not the $O_2$ sensor output has varied sharply, and means for computing the real mixing ratio from the feedback correction coefficient when the $O_2$ sensor output has varied sharply, the target mixing ratio computed several preceding occasions beforehand and a predetermined damping coefficient.

5. An air-fuel ratio controller for an engine having a combustion chamber, an intake passage for supplying air to said chamber and a fuel injector for injecting fuel into said intake passage, comprising:

means for calculating a target mixing ratio based on engine running conditions, means for detecting a real mixing ratio of fuel and air supplied to said combustion chamber, means for detecting a difference between the real mixing ratio and the target mixing ratio as a mixing ratio error, means for computing a mixing ratio feedback correction coefficient for feedback correction of an injection fuel amount based on the mixing ratio error, means for applying a correction to the injection fuel amount based on the feedback correction coefficient, means for detecting whether the engine is in a transient running state, means for detecting an amount representative of the transiency of the transient running state, a memory for continuous storage of mixing ratio errors and the transiency amounts in the transient running state, means for computing a slope of a correlation between the stored mixing ratio errors and transiency amounts, means for computing an injection fuel correction amount in the transient running state so as to eliminate said slope, a memory for storing said computed correction amount as a learned value, and means for correcting the injection fuel amount in the transient running state based on a previously learned value.

6. An air-fuel ratio controller as defined in claim 5, wherein said real mixing ratio detection means comprises an air-fuel ratio sensor for directly detecting the air-fuel ratio from the engine exhaust gas composition, and means for converting the air-fuel ratio to the mixing ratio.

7. An air-fuel ratio controller as defined in claim 5, wherein said real mixing ratio detection means comprises an $O_2$ sensor of which the output varies sharply at the theoretical air-fuel ratio in response to the engine exhaust gas composition, means for judging whether or not the $O_2$ sensor output has varied sharply, and means for computing the real mining ratio form the target mixing ratio and the feedback correction coefficient when the $O_2$ sensor output has varied sharply.

8. An air-fuel ratio controller as defined in claim 5, wherein said real mixing ratio detection means comprises an $O_2$ sensor of which the output varies sharply at the theoretical air-fuel ratio in response to the engine exhaust gas composition, means for judging whether or not the $O_2$ sensor output has varied sharply, and means for computing the real mixing ratio from the feedback correction coefficient when the $O_2$ sensor output has varied sharply, the target mixing ratio computed several preceding occasions beforehand and a predetermined damping coefficient.

* * * * *